US012728329B2

(12) United States Patent
Cameron et al.

(10) Patent No.: US 12,728,329 B2
(45) Date of Patent: Sep. 8, 2026

(54) PUTTER GRIP TO HELP WITH GOLF CLUB ALIGNMENT

(71) Applicant: Acushnet Company, Fairhaven, MA (US)

(72) Inventors: Don T. Cameron, Carlsbad, CA (US); Augustin W. Rollinson, Carlsbad, CA (US); Nicholas C. Wade, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 1094 days.

(21) Appl. No.: 17/862,244

(22) Filed: Jul. 11, 2022

(65) Prior Publication Data

US 2022/0347534 A1 Nov. 3, 2022

Related U.S. Application Data

(63) Continuation-in-part of application No. 29/843,655, filed on Jun. 22, 2022, now Pat. No. Des. 1,019,847, and a continuation-in-part of application No. 17/718,085, filed on Apr. 11, 2022, now Pat. No. 12,121,788, which is a continuation of application No. 17/167,335, filed on Feb. 4, 2021, now Pat. No. 11,413,512, which is a continuation-in-part of (Continued)

(51) Int. Cl.

| | |
|---|---|
| ***A63B 60/42*** | (2015.01) |
| ***A63B 53/00*** | (2015.01) |
| ***A63B 69/36*** | (2006.01) |

(52) U.S. Cl.

CPC ..... *A63B 60/42* (2015.10); *A63B 53/007* (2013.01); *A63B 69/3685* (2013.01); *A63B 2209/08* (2013.01)

(58) Field of Classification Search

CPC ..... A63B 60/06–60/34; A63B 60/00; A63B 59/60–59/80; A63B 49/00–49/14; A63B 43/14; A63B 69/3685; A63B 60/42; A63B 53/007

USPC ..... 473/298–303, 549–552, 568; D21/756

See application file for complete search history.

(56) References Cited

U.S. PATENT DOCUMENTS

| | | | | |
|---|---|---|---|---|
| 259,448 | A * | 6/1882 | Woodhouse | A63B 60/14 473/551 |
| 621,993 | A * | 3/1899 | Crosier | A63B 53/14 473/298 |

(Continued)

FOREIGN PATENT DOCUMENTS

| | | |
|---|---|---|
| JP | 2008264526 | 6/2008 |
| JP | 2010-088844 A | 4/2010 |
| JP | 2017153556 | 9/2017 |

*Primary Examiner* — Sebastiano Passaniti

(74) *Attorney, Agent, or Firm* — Ryan A. Reis

(57) ABSTRACT

A golf club fitting apparatus and a grip for helping with golf club alignment are provided. The golf club fitting apparatus may be attached to a golf club and provide fitting information including effective lie angle and effective loft angle. An angle indicator is disposed at a predetermined angle relative to a shaft axis of the golf club so as to rest in a neutral position when the golf club is in a normal address position. A grip is provided that may be attached to a golf club shaft such that a butt end and/or distal end of the grip have a surface that helps with golf club alignment. A grip is provided with a front portion having edges that help with golf club alignment.

6 Claims, 29 Drawing Sheets

Related U.S. Application Data application No. 16/693,036, filed on Nov. 22, 2019, now Pat. No. 11,173,370.

(56) References Cited

U.S. PATENT DOCUMENTS

| | | | | | |
|---|---|---|---|---|---|
| 2,149,911 | A * | 3/1939 | East | A63B 60/10 473/201 |
| 3,909,004 | A | 9/1975 | Vella | |
| 4,186,923 | A * | 2/1980 | Garner | A63B 59/55 473/565 |
| 4,482,155 | A | 11/1984 | Higley | |
| 4,927,151 | A | 5/1990 | Ronnick | |
| 5,174,572 | A | 12/1992 | Ho | |
| 5,207,429 | A | 5/1993 | Walmsley | |
| 5,476,258 | A | 12/1995 | Frisone | |
| 5,509,657 | A | 4/1996 | Guthry | |
| D375,268 | S | 11/1996 | Stryczek | |
| 5,582,554 | A | 12/1996 | Stryczek | |
| 5,632,484 | A | 5/1997 | Lambert | |
| 5,893,804 | A | 4/1999 | Pan | |
| D417,895 | S * | 12/1999 | Kim | D21/756 |
| 6,551,198 | B2 * | 4/2003 | Huang | A63B 53/007 473/301 |
| 6,863,618 | B2 * | 3/2005 | Perry | A63B 53/10 473/316 |
| D524,390 | S * | 7/2006 | Tuerschmann | D21/756 |
| 8,061,051 | B2 | 11/2011 | Allemand | |
| D915,536 | S * | 4/2021 | Bradford | D21/756 |
| 2002/0151376 | A1 | 10/2002 | Verne | |
| 2003/0181254 | A1 * | 9/2003 | Zichmanis | A63B 60/10 473/313 |
| 2004/0259660 | A1 | 12/2004 | Zichmanis | |
| 2005/0197202 | A1 * | 9/2005 | Huang | D06N 3/14 473/300 |
| 2007/0287551 | A1 * | 12/2007 | Wang | A63B 60/10 473/300 |
| 2008/0155843 | A1 | 7/2008 | Yun | |
| 2014/0173923 | A1 | 6/2014 | Van Bortel | |
| 2020/0238142 | A1 | 7/2020 | Trulaske | |

* cited by examiner

PUTTER GRIP TO HELP WITH GOLF CLUB ALIGNMENT

CROSS-REFERENCE TO RELATED APPLICATIONS

This application is a continuation-in-part of U.S. patent application Ser. No. 17/718,085, filed on Apr. 11, 2022, which is a continuation of U.S. patent application Ser. No. 17/167,335, filed on Feb. 4, 2021, which is a continuation-in-part of U.S. patent application Ser. No. 16/693,036, now U.S. Pat. No. 11,173,370, filed on Nov. 22, 2019, which are hereby incorporated by reference in its entirety. This application is also a continuation-in-part of U.S. patent application Ser. No. 29/843,655, filed on Jun. 22, 2022, which is hereby incorporated by reference in its entirety.

FIELD OF THE INVENTION

The present invention relates to golf club fitting and, more particularly, to an apparatus for properly fitting a putter.

BACKGROUND

The point of golf is to get the ball into the hole in the fewest number of strokes possible. Every stroke counts the same on the scorecard, whether that stroke is a 300-yard drive or a 1-foot putt. Not everyone can hit the ball 300-yards, but everyone can hit a putt 1-foot. Therefore, one of the best ways to improve your golf score is to improve your putting.

Practice is one way to improve putting, but it is not the only way. It is also possible to improve putting by ensuring that a putter is properly fitted and properly aligned.

Even if a putting stroke is technically perfect a golfer will struggle to hole putts if their putter is not properly fitted and/or they cannot aim at their intended target. There are many ways that a putter can be tailored for a golfer.

FIG. 1 illustrates components of a conventional putter. As shown in FIG. 1, a putter 100 includes a striking face 101, a sole 102, and a hose) or neck 103 for connecting the putter head 104 to a shaft 105.

FIG. 1 illustrates several different ways that a putter can be oriented at address. It is noted that like reference numerals are omitted. A putter 100 is shown leaning forward or delofted (A), in a neutral address position (B), and leaning backward (C).

Loft is the angle between the striking face and a vertical plane perpendicular to the ground plane G when the putter is held in a normal address position. Effective loft is the angle between the striking face and a vertical plane perpendicular to the ground plane G in an actual address position. Therefore, while the loft of a putter 100 is static based on the geometry of the putter, the effective loft can change depending on how the putter 100 is leaning when addressing a ball.

A putter needs to have some effective loft, typically about 4°, to most effectively roll a golf ball. This angle is sufficient to lift the ball ever so slightly off of the ground so that the ball can quickly get into a roll. Each of the putters 100 depicted by (A), (B), and (C) has about 4 degrees of loft. However, each of the putters 100 depicted by (A), (B), and (C) has a different effective loft. The putter 100 depicted by (B) is in a normal address position, and therefore the effective loft $\alpha_B$ is equal to 4°, the loft of the putter.

If the effective loft of a putter is too low, then a putted ball will be driven down into the ground as depicted by (A) in FIG. 1. The putter 100 depicted by (A) has an effective loft $\alpha_A$ of about −1°. This will cause the putted ball to hop and subsequently bounce, which makes it difficult to hit the ball consistently in terms of distance and/or direction.

If the effective loft of the putter is too high, the putted ball will be driven into the air, possibly with backspin, as depicted by (C) in FIG. 1. The putter 100 depicted by (C) has an effective loft $\alpha_C$ of about 9°. These conditions also make it difficult to hit the ball consistently in terms of distance and/or direction.

It is critical to use a putter having the proper loft, as a fraction of a degree of loft can have drastic effects on how a putt is rolled. However, without special equipment it is difficult to correctly identify proper loft of a putter.

FIG. 2 illustrates additional features of a conventional putter. As shown in FIG. 2, the putter 100 also includes a heel 106, a toe 107, and a lie angle.

Lie angle is the angle between the center of the shaft 105 and the ground plane G when the putter 100 is soled in its normal address position. Effective lie angle is the angle between the center of the shaft and the ground plane G when the putter is held in an actual address position. The rules of golf govern that a putter must have a lie angle of less than 80 degrees. Like loft, it is important that a golfer use a putter having the proper lie angle.

FIG. 2 illustrates the effect of lie angle and effective lie angle on a putted golf ball by showing several different ways that a putter can be oriented at address. As shown in FIG. 2, a putter 100 is shown with the toe 107 higher than the heel 106 (A), in a neutral address position (B), and with the heel 106 higher than the toe 107 (C).

When a ball is putted using a putter 100 with a lie angle that is too upright (A), the putter 100 will be oriented with the toe 107 higher than the heel at impact as shown in (A). The putter 100 depicted by (A) has an effective lie angle $\beta_A$ of about 65°, which is about 5° less than the actual lie angle of the putter 100. In this position, the loft of the putter 100 will cause the ball to be missed to the left of where the putter is aiming. As shown in FIG. 2, the aiming line is denoted by a solid black line while the arrow shows where the ball will actually be hit.

When a ball is putted using a putter with the correct lie angle (B), the lie angle and the effective lie angle are equal. The putter 100 depicted by (B) has an effective lie angle $\beta_B$ of about 70°, which is equal to the lie angle. The putter 100 depicted by (B) is oriented substantially parallel to the ground plane G at impact and the ball will roll in the direction that the putter is aiming.

When a ball is putted using a putter with a lie angle that is too flat (C), the putter will be oriented with the toe 107 lower than the heel 106 at impact. The putter 100 depicted by (C) has an effective lie angle $\beta_C$ of about 75°, which is about 5° more than the actual lie angle of the putter 100. In this position, and the loft of the putter will cause the ball to go to the right of where the putter is aiming.

Therefore, it is critical to use a putter having the proper lie angle, as a fraction of degree of lie angle have drastic effects on how a putt is rolled. However, without special equipment it is difficult to correctly identify proper lie angle.

FIG. 3 illustrates the ideal path that a putter head should take during the putting stroke. It is important to swing the putter in the proper way. Since all putters are required by rule to have a lie angle, it follows that the ideal putting stroke is not that of a pendulum, but rather one where the putter head 104 follows an arc-shaped path 310 influenced by the lie angle of the putter that deviates from the target line 311. Also shown in FIG. 3 is the "toe-flow" 312 of the putter that illustrates how the putter head 104 does not remain square to the target line 311 during the stroke, but rather opens and closes like a gate by remaining square to the arc-shaped path 310. The arc-shaped path 310 may also be encouraged by the eye-line 313 being inside of the target line 311. The eye-line 313 corresponds to a vertical plane extending down from the eyes and into the ground plane G. Swinging the putter without the proper arc-shaped path will require compensations and adjustments in the putting stroke that make it difficult to precisely strike putts.

It is also very important to properly aim the putter when putting. Even if a putter has the perfect loft and lie angle and is swung along the perfect arc-shaped path, it is still difficult to make putts when the putter is not properly aimed. It is not uncommon for golfers to aim a putter multiple degrees right or left of their intended target. The longer the putt, the more such an error in aim will affect the results of a putt. For example, aiming just 1-degree to the right or left of your target from 10 feet away is the equivalent of missing your target by 2.1 inches. As a regulation golf cup is only 4.25 inches wide, this 1-degree error is enough to be the difference between making a putt for par or missing the putt and making a bogey.

Therefore, a system for properly fitting and aiming a putter is needed. The present invention provides such a system and fitting method.

SUMMARY OF THE INVENTION

The systems, methods, and devices described herein have innovative aspects, no single one of which is indispensable or solely responsible for their desirable attributes. Without limiting the scope of the claims, some of the advantageous features will now be summarized.

The present technology generally relates to a club fitting apparatus and a method of fitting golf clubs, and more particularly, the apparatus and method related to putter type golf clubs. More specifically, the present invention is directed to system and methods that enable a player to adjust the putter or the orientation of the putter to achieve an optimal setup position. By improving the setup position, the player will inherently improve putting efficiency.

One aspect of the invention herein is directed to a fitting apparatus for a golf club. The fitting apparatus may include a first apparatus body having a first opening defined in said first apparatus body for receiving a shaft of said golf club; a first angle indicator coupled to said first apparatus body and exposed on an upper surface of said first apparatus body; a second angle indicator coupled to said first apparatus body and exposed on said upper surface of said first apparatus body; and a stroke-plane indicator coupled to said first apparatus body and exposed through a lower surface of said first apparatus body.

According to an embodiment, said first opening may be defined in said first apparatus body at a first predetermined angle relative to a normal of said lower surface of said apparatus.

The first predetermined angle may be between about 0° and about 30° relative to said normal of said lower surface of said first apparatus body.

The first predetermined angle may preferably be between about 15° and about 25° relative to said normal of said lower surface of said first apparatus body.

The first predetermined angle is most preferably about 20° relative to said normal of said lower surface of said first apparatus body and corresponds to a lie angle of said golf club.

The first angle indicator may be configured to measure changes corresponding to an effective lie angle of said golf club, where said effective lie angle of said golf club is the angle between a shaft of said golf club and a ground plane when said golf club is held in an address position.

The second angle indicator may be configured to measure changes corresponding to an effective loft angle of said golf club, wherein said effective loft angle of said golf club is the angle between a striking face of said golf club and a normal to a ground plane when said club is held in an address position.

The fitting apparatus may further include a second opening defined in said first apparatus body at said first predetermined angle, and the second opening may be configured to receive said stroke-plane indicator therein.

The stroke-plane indicator may include a collimated light source and when received within said second opening said collimated light source may emit collimated light.

The fitting apparatus may include a fastener that is securable through a lateral surface of said first apparatus body adjacent the first opening.

The fastener may be securable through said lateral surface of said first apparatus body at an angle that is complementary to said first predetermined angle.

Another aspect of the invention herein is directed to a system for fitting a putter that includes a putter having a body, a striking face; a rear surface opposite said striking face; a heel; a toe opposite said heel; a sole; an upper surface opposite said sole; and a shaft attached to said golf club head. The system may further include a fitting apparatus that includes a first apparatus body; a first opening defined in said first apparatus body for receiving said shaft of said putter, the first opening being defined at a first predetermined angle; a fastener configured to apply a force to said putter shaft within said first opening, where said fastener is securable through a lateral surface of said first apparatus body adjacent the first opening; a first angle indicator coupled to said first apparatus body and exposed on an upper surface of said first apparatus body, wherein said first angle indicator is configured to measure a difference between an effective lie angle of said putter and a prescribed lie angle of said putter when said putter is held at an address position, wherein said effective lie angle of said putter is the angle between said and a ground plane when said putter is held in an address position; a second angle indicator coupled to said first apparatus body and exposed on said upper surface of said first apparatus body, wherein said second angle indicator is configured to measure a difference between an effective loft angle of said putter and a prescribed loft angle of said putter when said putter is held at said address position, wherein said effective loft angle of said putter is the angle between said striking face and a normal to a ground plane when said putter is held in an address position; a second opening defined in said first apparatus body at said first predetermined angle, wherein said second opening is configured to receive a collimated light source therein and expose said collimated light source through a lower surface of said first apparatus body; and a first recess defined in said lower surface of said first apparatus body, wherein the first recess is configured to receive said collimated light source; and a reflective member removably attached to said striking face. In a first configuration said fitting apparatus is coupled to said shaft of said putter such that said collimated light source emits light in a direction parallel to said shaft toward said ground plane, and in a second configuration said collimated light source emits light in a direction parallel to an aiming line toward said reflective member.

The first predetermined angle may be between about 0° and about 30° relative to a normal of said lower surface of said first apparatus body.

The first predetermined angle may be between about 15° and about 25° relative to said normal of said lower surface of said first apparatus body.

The first predetermined angle may be about 20° relative to said normal of said lower surface of said first apparatus body and corresponds to a lie angle of said putter.

The fastener may be securable through said lateral surface of said first apparatus body at an angle that is complementary to said first predetermined angle.

According to another aspect of the invention herein, a method for fitting a putter with a fitting apparatus may include attaching said fitting apparatus to a shaft said putter; measuring, by said fitting apparatus, at least one of an effective lie angle, an effective loft angle, and a stroke plane of said putter when said putter is held in an address position; and modifying at least one of said putter and said address position to adjust said at least one of said effective lie angle, said effective loft angle, and said stroke plane.

The effective loft angle may be measured with a first angle indicator exposed through an upper surface of said fitting apparatus, the effective lie angle of said putter is measured with a second angle indicator exposed through an upper surface of said fitting apparatus, and said stroke plane is measured with a collimated light source that is exposed through a lower surface of said fitting apparatus so as to emit a beam of collimated light in a direction parallel to said shaft.

The method for fitting a putter may further include removing said fitting apparatus from said shaft; positioning said fitting apparatus on a ground plane; placing said collimated light source on said fitting apparatus so as to emit a beam of collimated light in a direction substantially parallel to said ground plane; aiming said putter toward said collimated light source such that said beam of collimated light contacts a reflective surface disposed on a striking face of said putter; measuring a location of a beam reflected from said reflective surface; and modifying at least one of said putter and said address position to adjust said location of said beam reflected from said reflective surface.

According to another aspect of the invention herein, a golf club fitting apparatus for a golf club including a shaft defining a shaft axis, a golf club head connected to a first end of said shaft, and a grip connected to a second end of said shaft opposite said first end, includes: a second apparatus body having a lower surface, an upper surface opposite said lower surface, and a lateral surface connecting said upper surface and said lower surface; an angle indicator coupled to said second apparatus body and exposed on said upper surface of said second apparatus body; where said second apparatus body is adapted to be coupled to said grip such that said lower surface of said second apparatus body contacts a butt end of said grip, and where said angle indicator is disposed at a predetermined angle relative to said shaft axis such that said angle indicator is in a neutral position when said golf club is in a normal address position.

According to another aspect of the invention herein, a method for fitting a putter with a fitting apparatus, includes attaching said fitting apparatus to a grip of said putter; measuring, by said fitting apparatus, at an effective lie angle and an effective loft angle of said putter when said putter is held in an address position; and modifying at least one of said putter and said address position to adjust said at least one of said effective lie angle and said effective loft angle.

According to another aspect of the invention herein, a grip for a golf club including a shaft defining a shaft axis, a golf club head connected to a first end of said shaft, and said grip connected to a second end of said shaft opposite said first end, includes: said grip having a butt end furthest from said golf club head; and a distal end opposite said butt end; wherein said butt end and/or said distal end of the grip are angled with respect to a plane normal to said shaft axis such that a top surface of said butt end and/or a bottom surface of said distal end are substantially parallel to a ground plane when said golf club is in a normal address position.

According to another aspect of the invention herein, the grip having said butt end and/or said distal end angled with respect to said plane normal to said shaft axis may be combined with an apparatus body, wherein said apparatus body is coupled to said grip such that a lower surface of said apparatus body contacts said butt end of said grip, and wherein an upper surface of said apparatus body is substantially parallel to said top surface of said butt end of said grip such that an angle indicator located on said upper surface of said apparatus body is in a neutral position when said golf club is in a normal address position.

According to another aspect of the invention herein, a grip for a golf club including a shaft defining a shaft axis, a golf club head connected to a first end of said shaft, and said grip connected to a second end of said shaft opposite said first end, includes: said grip having a butt end furthest from said golf club head, a distal end opposite said butt end, a front portion, a rear portion, a left side portion, and a right side portion; said front portion, said rear portion, said left side portion, and said right side portion extending along a length of said grip from said butt end to said distal end; wherein said front portion includes a left edge and a right edge extending said length of said grip, said left edge and said right edge being symmetrical to each other along a centerline of said front portion; wherein, moving from said butt end to said distal end of said grip, said left edge and said right edge taper away from said centerline of said front portion then taper back towards said centerline of said front portion near said distal end of said grip; wherein a plane including said right edge and said left edge may be formed which is parallel to a target line in a normal address position.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

Figure 1:
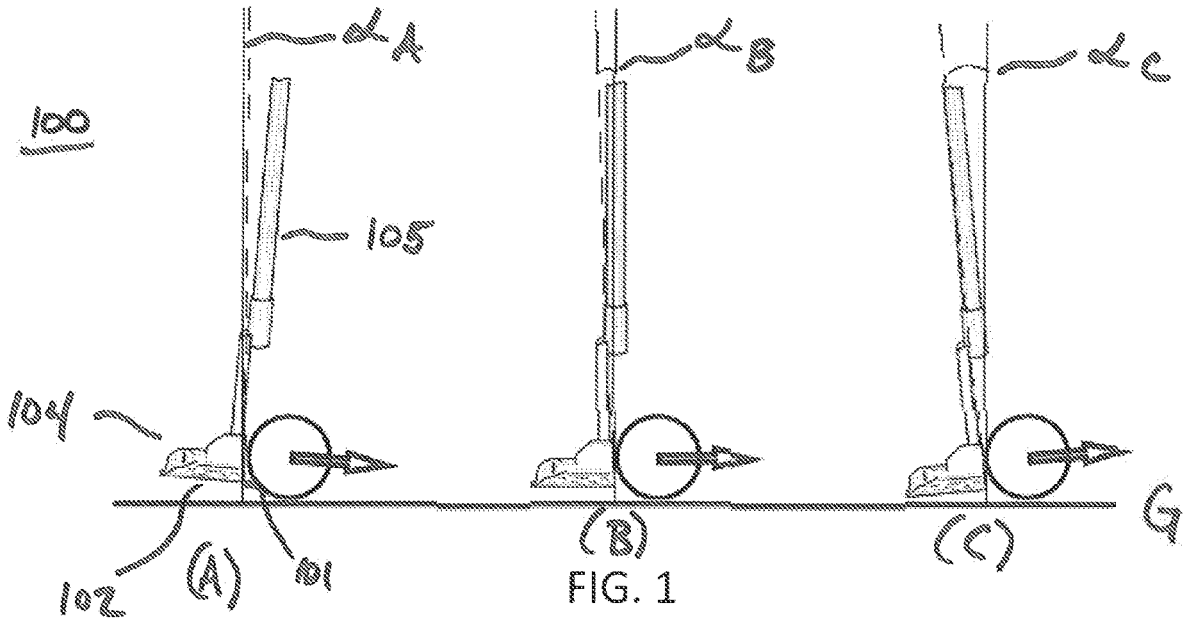
FIG. 1 shows a putter with varying degrees of shaft-lean modifying the effective loft of a putter.
Figure 2:
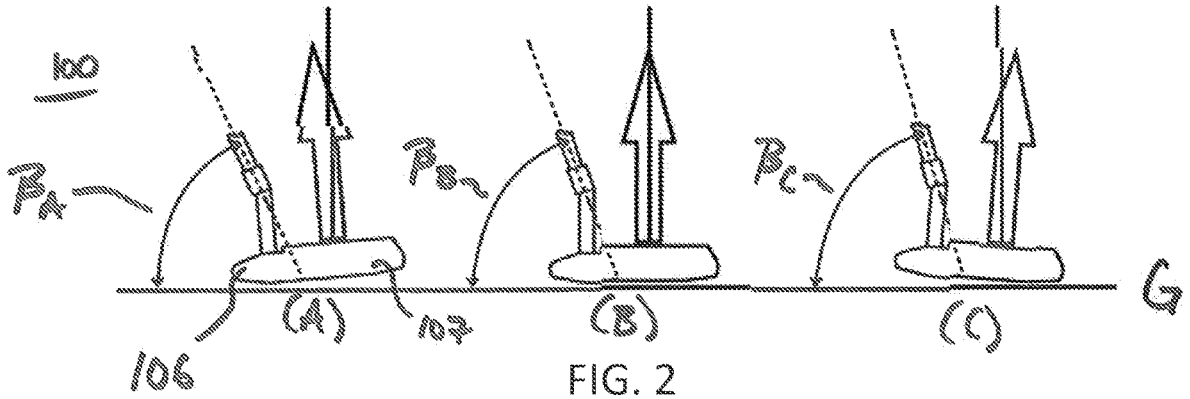
FIG. 2 shows a putter with varying degrees of shaft-lean modifying the effective lie angle of a putter.
Figure 3:
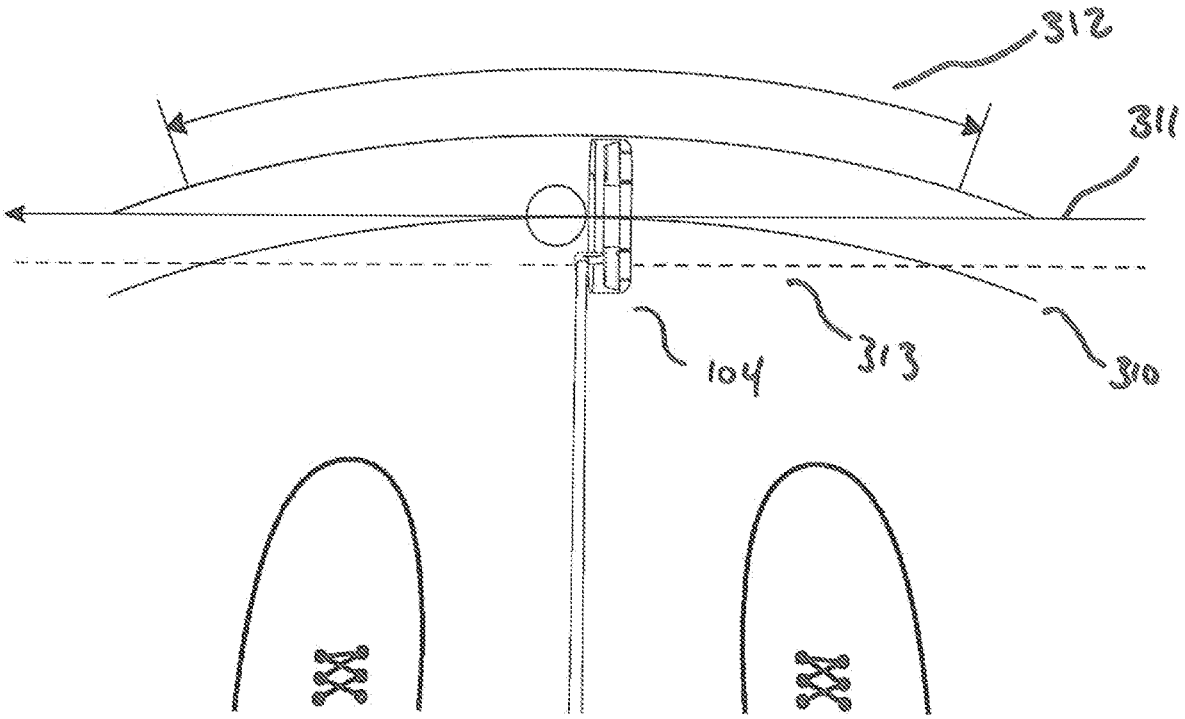
FIG. 3 shows an arc-shaped putting stroke.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and bounce angles, power spectrums, frequencies and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly, after reading the section entitled "Detailed Description" one will understand how the illustrated features serve to explain certain principles of the present disclosure.

Figure 4:
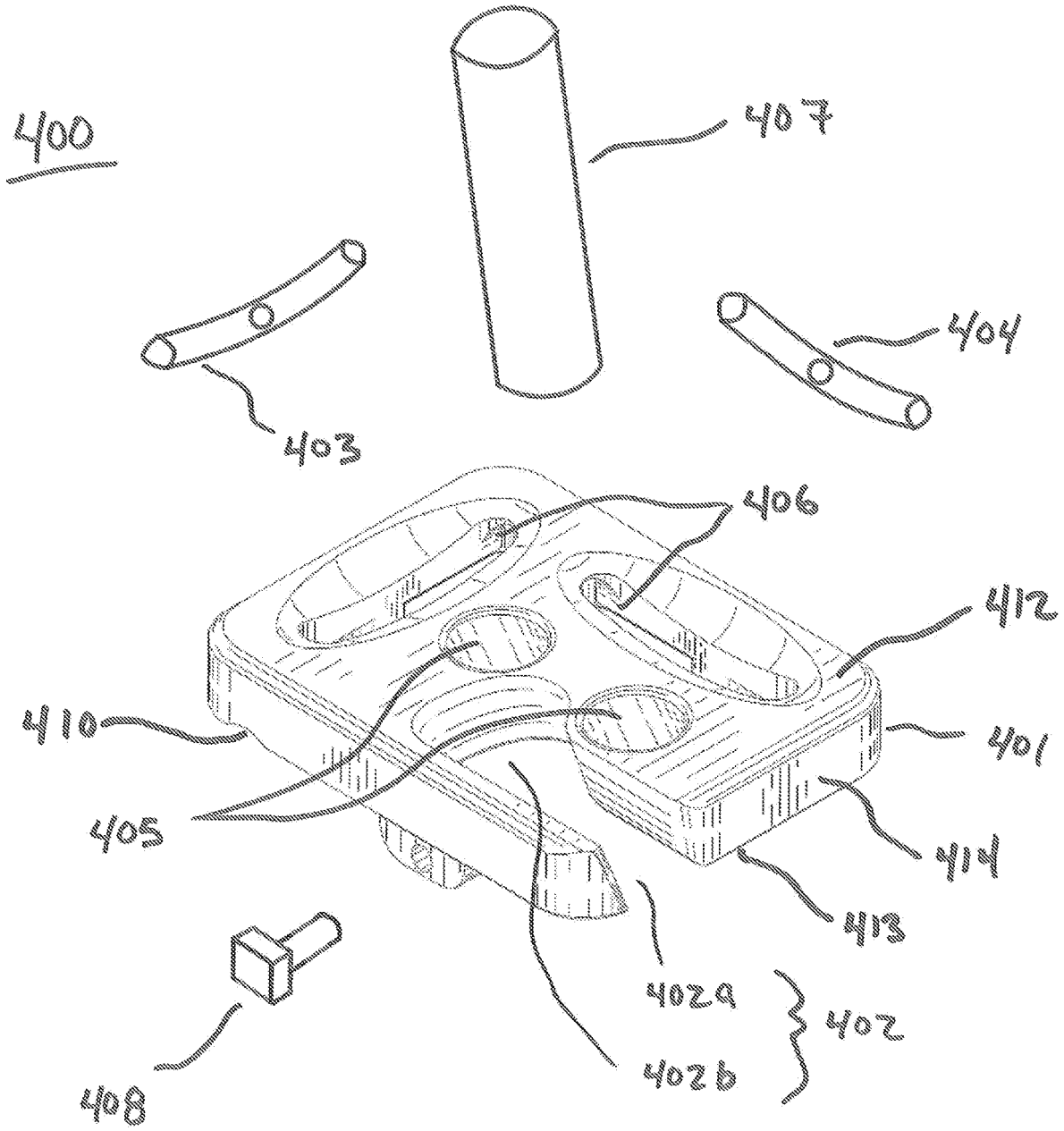
FIG. 4 shows an exploded perspective view of a golf club fitting apparatus in accordance with an exemplary embodiment of the present invention.
Figure 5:
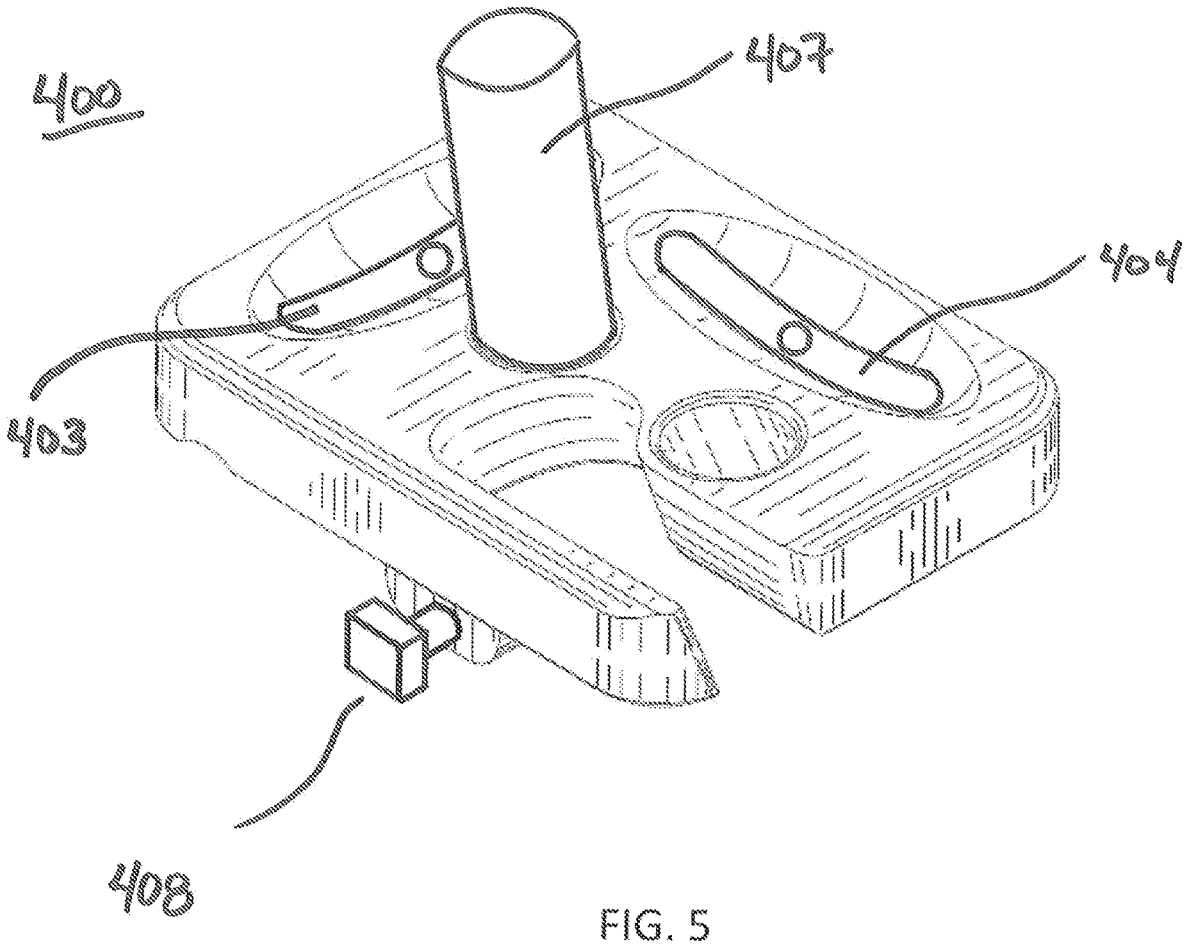
FIG. 5 shows a perspective view of a golf club fitting apparatus in accordance with an exemplary embodiment of the present invention.
Figure 6:
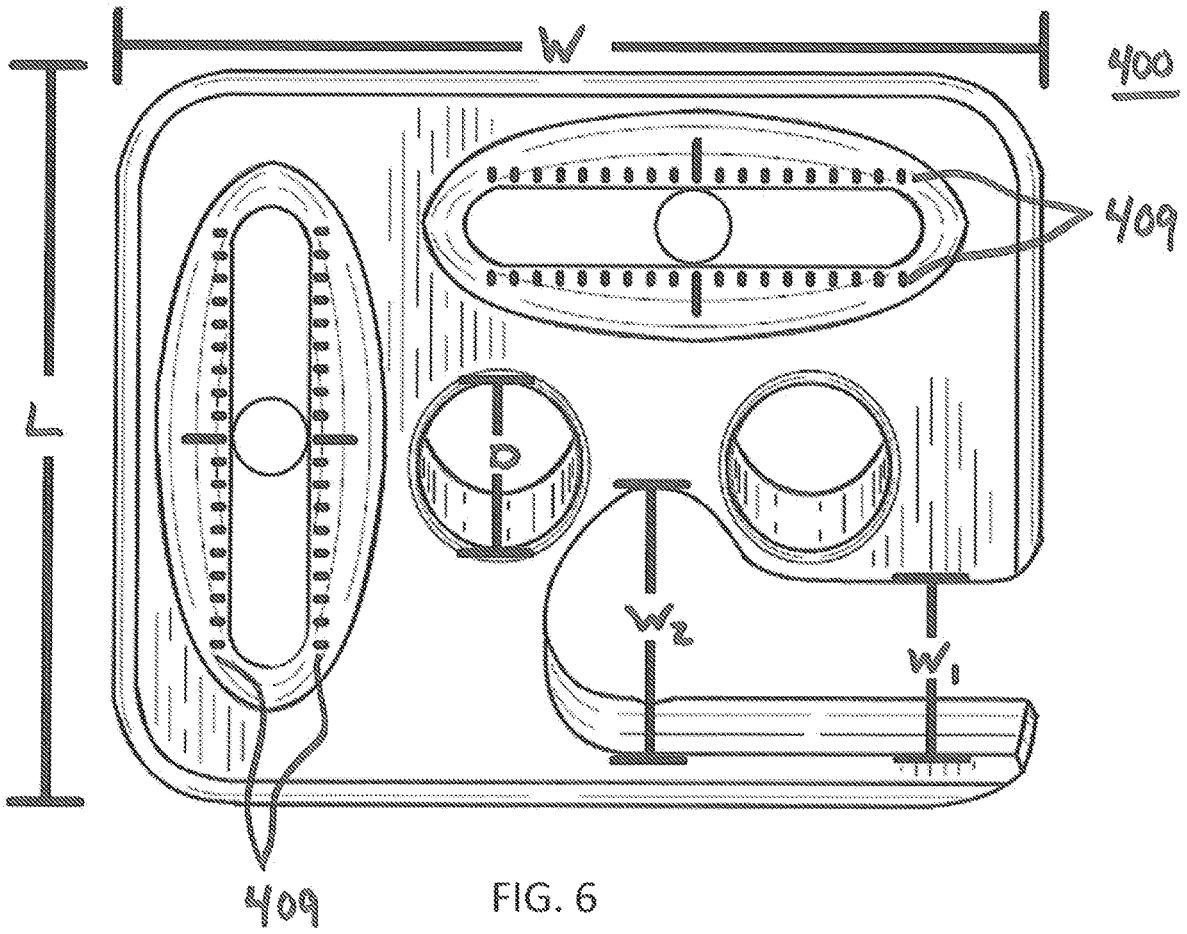
FIG. 6 shows an overhead view of a golf club fitting apparatus in accordance with an exemplary embodiment of the present invention.
Figure 7:
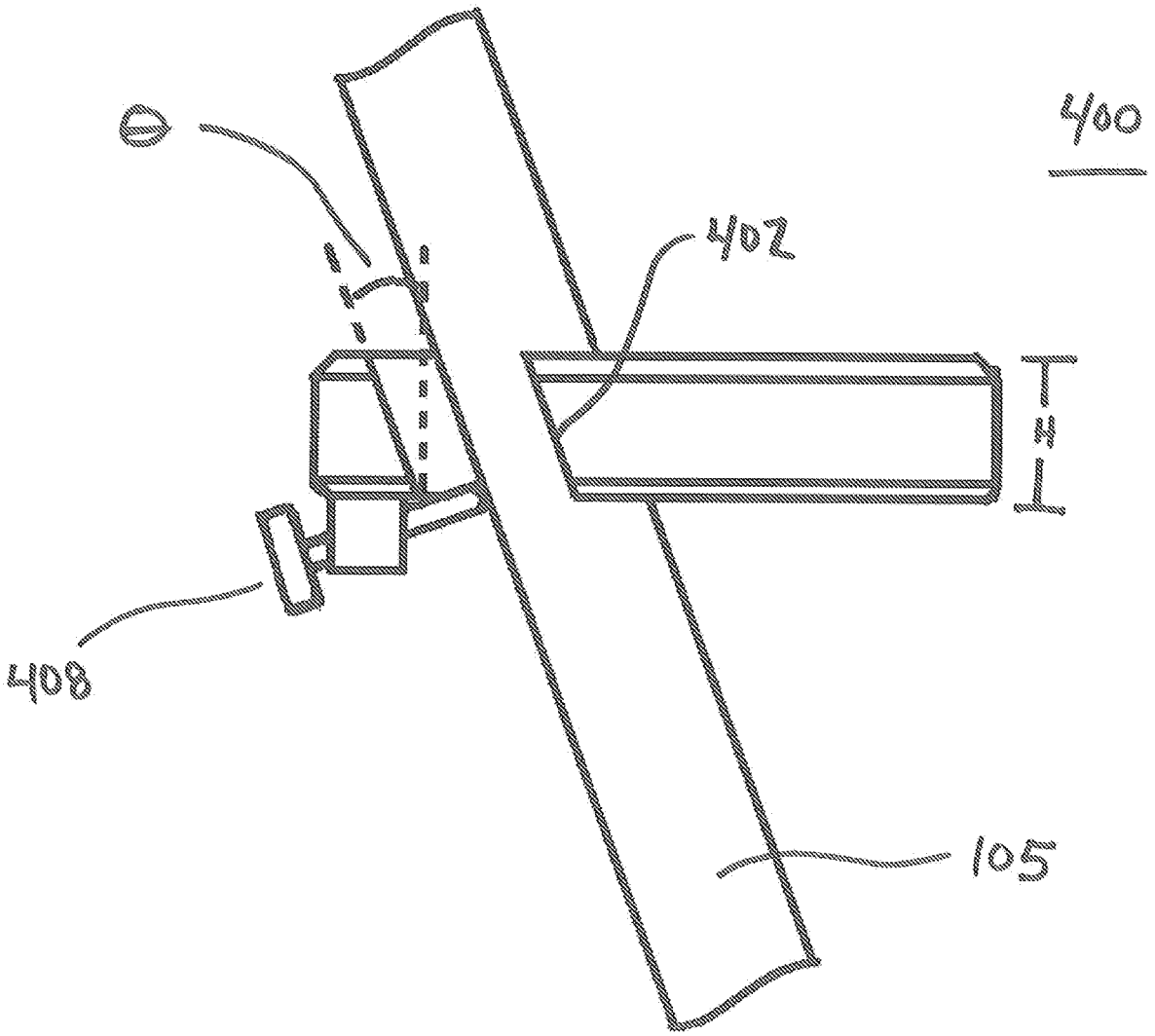
FIG. 7 shows a side view of a golf club fitting apparatus attached to a shaft in accordance with an exemplary embodiment of the present invention.

Referring to FIGS. 4-7, an embodiment of a golf club fitting apparatus 400 in accordance with the present invention is disclosed. FIG. 4 is an exploded view of a golf club fitting apparatus 400, FIG. 5 is a perspective view of the golf club fitting apparatus 400, FIG. 6 is an overhead view of the golf club fitting apparatus, and FIG. 7 is a side view of the golf club fitting apparatus 400.

As illustrated in FIGS. 4 and 5, golf club fitting apparatus 400 may include a first apparatus body 401, a first opening 402; a first angle indicator 403, a second angle indicator 404, one or more second openings 405, one or more third openings 406, a stroke-plane indicator 407, a fastener 408, and a first groove 410.

As illustrated in FIG. 5, the first opening 402 is defined through an upper surface 412 and a lower surface 413 of the golf club fitting apparatus 400 and includes a slot portion 402*a* defined through a lateral surface 414 of the golf club fitting apparatus 400 and an arcuate portion 402*b* connected to a terminal end of the slot portion 402*a*.

Referring to FIG. 6, an overhead of the golf club fitting apparatus 400 is shown to better illustrate relative dimensions. According to an embodiment of the present invention, the golf club fitting apparatus 400 may have a width W between about 2.0 inches to 5.0 inches. Preferably the width W of the golf club fitting apparatus 400 is between about 2.5 inches to about 3.5 inches. The golf club fitting apparatus 400 may have a length L of between about 1.5 inches to about 4.0 inches. Preferably, the length L of the golf club fitting apparatus 400 is between about 2.0 inches and about 3.0 inches.

The slot portion 402*a* of the first opening 402 may have a width W1 that is between about 0.5 inches to about 1.0 inch so as to accommodate insertion of a shaft. Preferably the slot portion 402*a* has a width W1 that is between about 0.5 inches to about 0.75 inches.

The arcuate portion 402*b* may have a larger width than that of the slot portion 402*a* to facilitate proper alignment the golf club fitting apparatus 400 on a shaft. According to an embodiment of the present invention, the arcuate portion 402*b* of the first opening 402 may have a width W2 that is between about 0.75 inches and 1.5 inches. Preferably the arcuate portion 402*b* has a width W2 that is between about 0.75 inches and 1.0 inch.

The second openings 405 may have a diameter D of between about 0.1 inches to about 1.0 inches. Preferably, the diameter D of the second openings 405 is between 0.25 inches and about 0.75 inches.

According to an embodiment of the present invention as shown in FIG. 7, the golf club fitting apparatus 400 may have a height H between about 0.1 inches to about 1.5 inches. Preferably the height H of the golf club fitting apparatus 400 is between about 0.25 inches to about 1.0 inches. Most preferably the height H of the golf club fitting apparatus is about 0.5 inches.

The first apparatus body 401 of the golf club fitting apparatus 400 may be formed of any suitable material. Preferably the first apparatus body 401 of the golf club fitting apparatus 400 is formed of a lightweight material so as to not overly affect the balance of the golf club when installed. The first apparatus body 401 of the golf club fitting apparatus 400 may be formed of metal, wood, plastic, or composites. According to an exemplary example, the first apparatus body 401 of the golf club fitting apparatus 400 may be formed of anodized 6061 aluminum.

Referring to FIG. 7, the golf club fitting apparatus 400 is shown from the side so as to clearly show a unique aspect of the first opening 402. As shown in FIG. 7, both the slot portion 402*a* and the arcuate portion 402*b* of the first opening 402 may be defined at a first angle θ relative to the normal to the lower surface 413 of the golf club fitting apparatus 400. The first angle θ ensures that the golf club fitting apparatus 400 will be substantially parallel to a ground plane G when attached to the shaft 105 of a putter that is held in a normal address position. The first angle θ may be in a range of about 0° to about 30° relative to the normal of the lower surface 413 of the golf club fitting apparatus 400. Preferably the first angle θ may be in a range of about 15° to about 25° relative to the normal of the lower surface 413 of the golf club fitting apparatus 400. Most preferably the first angle θ may be about 20° relative to the normal of the lower surface 413 of the golf club fitting apparatus 400 and corresponding to a lie angle α of a putter.

As shown in FIGS. 5 and 7, the fastener 408 is configured to project into the first opening 402 and apply a force to secure a shaft 105 within the arcuate portion 402*b* of the first opening 402. According to an embodiment of the present invention, the fastener 408 may be a threaded fastener that is mated into corresponding threads defined the golf club fitting apparatus 400. Alternatively, the fastener 408 may be friction fit into a corresponding opening defined in the golf club fitting apparatus 400.

According to an embodiment, as shown in FIG. 7 the fastener 408 may pass through a lateral surface 414 of the golf club fitting apparatus 400 at an angle that is complementary to the first angle θ. That is, a central axis of the fastener 408 may extend in a direction that is substantially orthogonal to an angled surface of the first opening 402. Alternatively, the fastener 408 may pass through a lateral surface 414 of the golf club fitting apparatus 400 at an angle that does not complement the first angle θ. For example, as shown in FIG. 5, the fastener 408 may pass through the lateral surface 414 of the golf club fitting apparatus 400 at an angle that is substantially orthogonal to the lateral surface 414 of the golf club fitting apparatus 400.

As illustrated in FIG. 7, when the shaft is secured within the golf club fitting apparatus 400, the fastener 408 applies a force to the shaft 105 such that the shaft 105 contacts the angled surface of the arcuate portion 402*b* opposite the fastener 408. The first angle θ of the surface of the arcuate portion 402*b* ensures that the golf club fitting apparatus 400 will be substantially parallel to the ground plane G when secured to the shaft 105.

Referring back to FIGS. 4 and 5, the second openings 405 are defined through an upper surface 412 and a lower surface 413 of the golf club fitting apparatus 400. The second openings 405 are configured to receive a stroke-plane indicator 407 such that the stroke-plane indicator 407 may be secured within either second opening 405 and exposed through a lower surface 413 of the golf club fitting apparatus 400. The stroke-plane indicator 407 may be secured within one of the second openings 405 through any number of known securing methods. For example, the stroke-plane indicator 407 may include a portion having an increased diameter greater than a diameter of the second openings 405 such that the stroke-plane indicator 407 cannot pass entirely through the second openings 405. Alternatively, the stroke-plane indicator 407 may have a tapered diameter and the second openings 405 may have either a uniform diameter or a corresponding tapered diameter that prevents the stroke-plane indicator 407 from passing entirely therethrough.

The second openings 405 may be defined at the first angle θ, and positioned such that an axis passing through a center of the stroke-plane indicator 407 is substantially parallel to a shaft angle of a putter secured within the first opening 402 and intersects the ground plane G in front of the striking face. According to an embodiment, the stroke-plane indicator 407 may be a collimated light source, such as that emitted from a laser (i.e., a solid state laser, laser pointer) of minimal power, typically about less than 3 mW. The axis passing through the center of the stroke-plane indicator 407 may be the beam of the laser.

Figure 8:
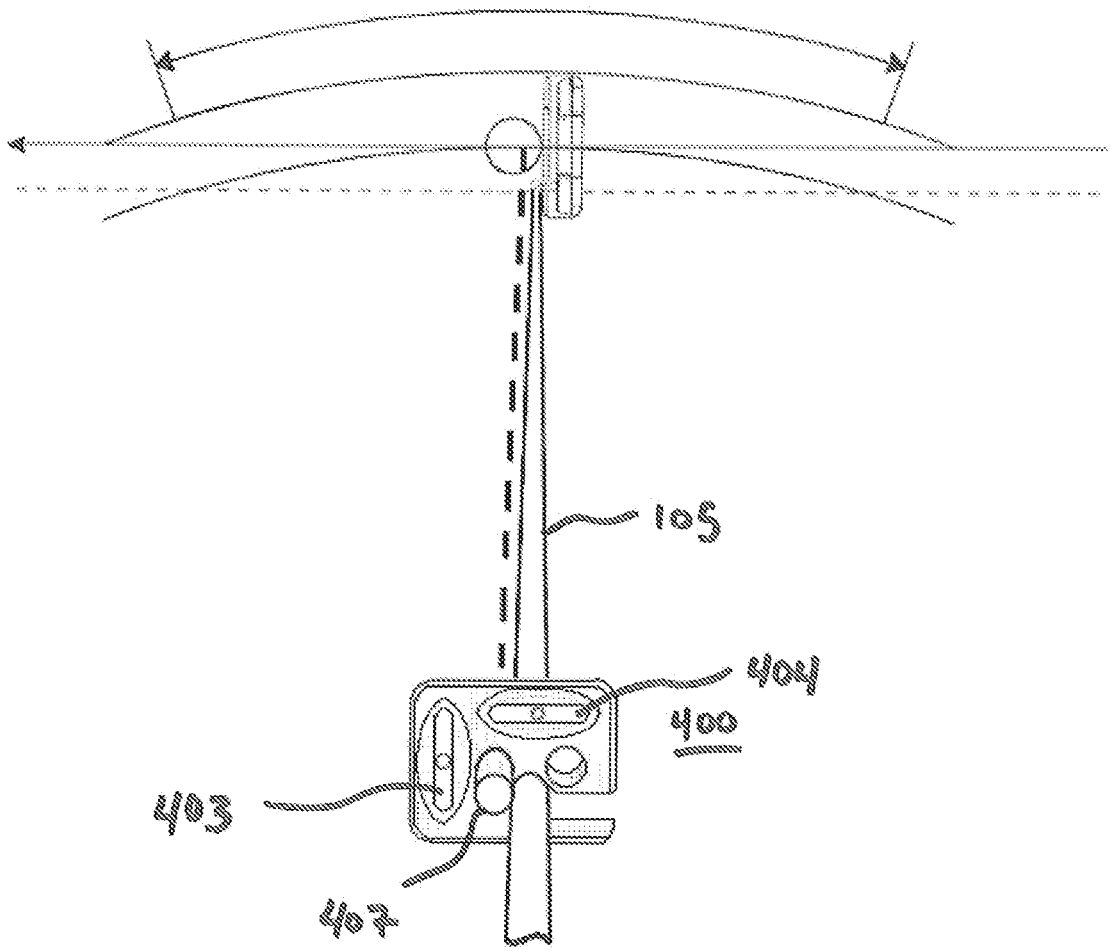
FIG. 8 shows an overhead view of a golf club fitting apparatus attached to a right-handed golf club in accordance with an exemplary embodiment of the present invention.
Figure 9:
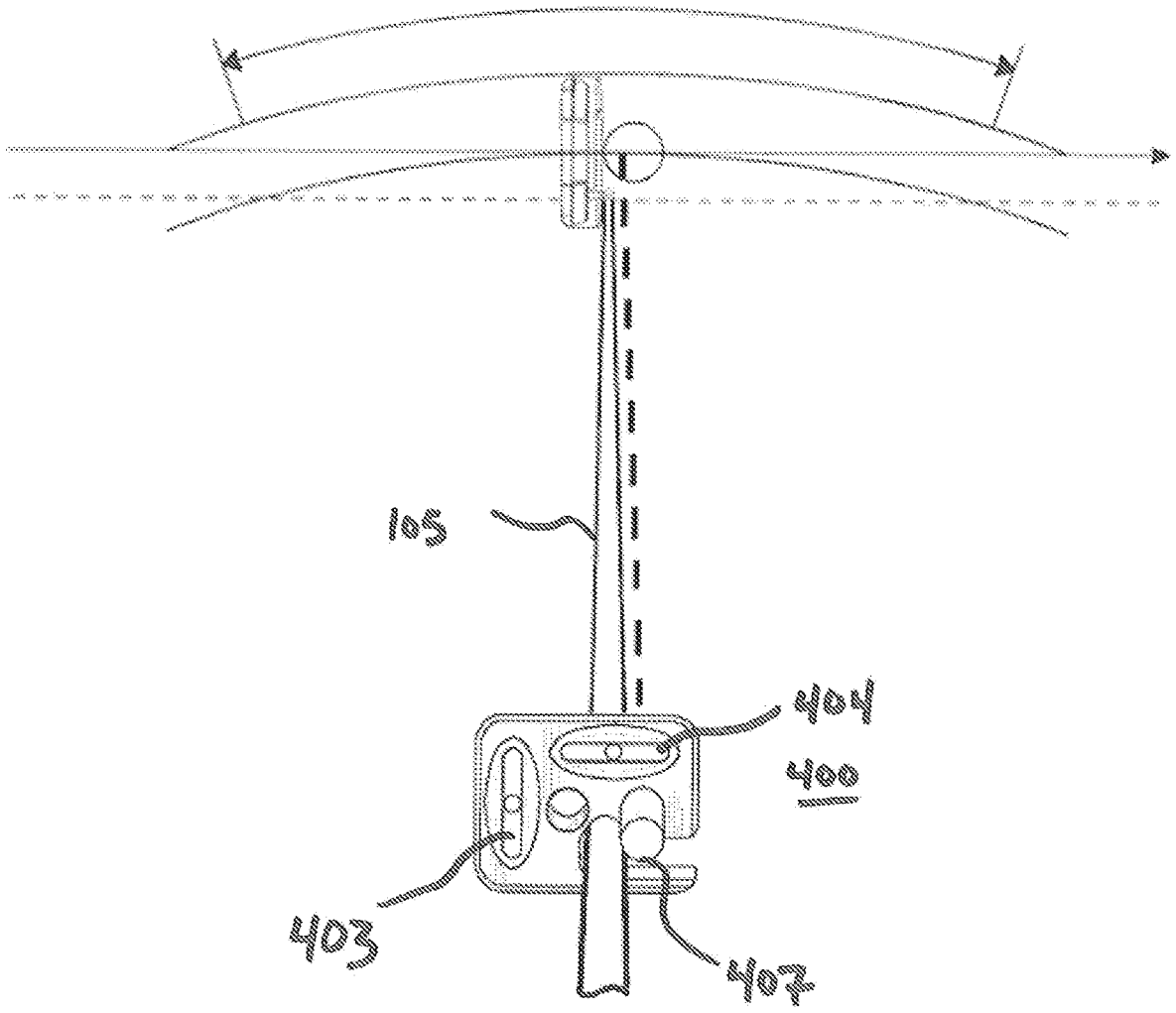
FIG. 9 shows an overhead view of a golf club fitting apparatus attached to a left-handed golf club in accordance with an exemplary embodiment of the present invention.

According to an embodiment of the present invention, the golf club fitting apparatus 400 may include two second openings 405 to accommodate both right-handed and left-handed putters. As shown in FIGS. 8 and 9, one of the second openings 405 is set to the left of where a shaft contacts the arcuate portion 402*b* of the first opening 402 and the other of the second openings is set to the right of where a shaft contacts the arcuate portion 402*b* of the first opening 402.

As shown in FIG. 8, when the golf club fitting apparatus 400 is attached to a right-handed putter, the shaft 105 of the right-handed putter is secured within the first opening 402 and the stroke-plane indicator 407 is secured in the second opening 405 that is located to the left of where the shaft 105 contacts the arcuate portion 402*b* of the first opening 402.

As shown in FIG. 9, when the golf club fitting apparatus 400 is attached to a left-handed putter, the shaft 105 of the left-handed putter is secured within the first opening 402 and the stroke-plane indicator 407 is secured in the second opening 405 that is located to the right of where the shaft 105 contacts the arcuate portion 402*b* of the first opening 402.

As shown in FIGS. 8-11, whether the golf club fitting apparatus 400 is attached to a right-handed or left handed golf club, the axis passing through a center of the stroke-plane indicator 407 is substantially parallel to a shaft 105 secured within the first opening 402 and intersects the ground plane G in front of the striking face at or near the center of the striking face. This relationship is independent of the height at which the golf club fitting apparatus 400 is attached to the shaft. It should be understood that the various geometries of putter shafts and putter necks/hosels may result in the axis passing through the center of the stroke-plane indicator 407 to intersect the ground plane G at slightly different positions, but the benefits of the present invention remain as described below.

Referring back to FIGS. 4-6, the golf club fitting apparatus 400 may include one or more angle indicators. According to an embodiment, the golf club fitting apparatus 400 includes a first angle indicator 403 and a second angle indicator 404. As shown in FIG. 6, the first angle indicator 403 and the second angle indicator 404 may be disposed substantially orthogonally to each other. The first angle indicator 403 may be disposed so as to be parallel to a leading edge of the striking face of a putter when the shaft of the putter is secured within the first opening 402. The second angle indicator 404 may be disposed so as to be parallel to an aiming line when a putter shaft is secured within the first opening 402.

According to an embodiment, the first angle indicator 403 and the second angle indicator 404 may be secured within third openings 406 so as to be exposed through an upper surface 412 of the golf club fitting apparatus 400. The third openings 406 may be defined partially or entirely through the first apparatus body 401 of the golf club fitting apparatus 400. Preferably the third openings 406 are defined entirely through the first apparatus body 401 of the golf club fitting apparatus 400. The first angle indicator 403 and the second angle indicator 404 may be secured within the third openings 406 either from above through the upper surface 412 of the golf club fitting apparatus 400 or from below through a lower surface 413 of the putter fitting apparatus 400. Preferably, the first angle indicator 403 and the second angle indicator 404 may be secured by press fitting or snap fitting into the third openings 406 through a lower surface 413 of the golf club fitting apparatus 400.

As shown in FIGS. 8 and 9, when the golf club fitting apparatus 400 is attached to a right-handed or left-handed putter, the first angle indicator 403 may indicate an effective lie angle of a putter and the second angle indicator 404 may indicate an effective loft of a putter.

Referring to FIG. 6, markings 409 may be defined on the first apparatus body 401 of the golf club fitting apparatus 400 proximate the first angle indicator 403 and the second angle indicator 404. The markings 409 may be defined on the first apparatus body 401 in any suitable manner, including but not limited to etched into, raised out of, or drawn onto the first apparatus body 401 of the golf club fitting apparatus 400. The markings 409 preferably indicate the effective lie angle and the effective loft angle in fractions of a degree over a range of more than 10 degrees. Alternatively, the markings 409 may be defined directly on the first angle indicator 403 and the second angle indicator 404.

Moreover, the first angle indicator 403 and the second angle indicator 404 may be provided in multiple different configurations so that the scale and range of the markings 409 may differ depending on the accuracy required for a particular fitting. For example, as the skill level of the golfer changes, different first angle indicators 403 and/or a second angle indicators 404 may be utilized that measure a smaller or larger overall ranges of angles, and therefore the markings 409 may represent larger or smaller increments, respectively.

By way of example, when a putter shaft 105 is secured within the first opening 402, if the putter shown in FIG. 8 were leaned in a more vertical direction, or "more upright," the first angle indicator 403 would indicate this change in angle. Similarly, if the putter shown in FIG. 7 were leaned in a downward direction, or "flatter," the first angle indicator 403 would indicate this change in angle.

Likewise, when a putter shaft is secured within the first opening 402, if the putter shown in FIG. 7 were leaned to the left, or "forward pressed," the second angle indicator 404 would indicate this change in angle. Similarly, if the putter shown in FIG. 8 were leaned to the right, or "reverse leaned," the second angle indicator 404 would indicate this change in angle.

Referring to FIG. 9, the golf club fitting apparatus 400 is shown when attached to a left-handed putter. The shaft of the left-handed putter is secured within the first opening 402 and the first angle indicator 403 and second angle indicator 404 are used to indicate effective lie angle and effective loft angle, respectively. In this configuration the effective lie angle may be measured on the same scale as in the right hand configuration, while the effective loft angle is measured using a second set of markings owing to the opposite loft angles on right and left handed clubs.

The first angle indicator 403 and the second angle indicator 404 may be any angle indicator, including but not limited to bubble levels, tilt sensors, tilt indicators, slope meters, slope gauges, gradient meters, gradiometers, level gauges, level meters, curved gas-filled inclinometers, and curved fluid-filled inclinometers. Preferably, the first angle indicator 403 and the second angle indicator 404 are curved vial-type fluid-filled inclinometers having a radius of curvature and being filled with a damping fluid that ensure a smooth responsive angle indication. The radius of curvature of the inclinometer will affect the range of range of measurement of the inclinometer. Therefore, the curvature may be adjusted depending on the desired range, for example based on the skill of the player.

When the inclinometers include a bubble indicator, the ends of the first angle indicator 403 and the second angle indicator 404 are oriented to be lower than a central portion thereof. Conversely, when the inclinometers include a ball indicator, the ends of the first angle indicator 403 and the second angle 404 indicator are oriented to be higher than a central portion thereof.

Figure 10:
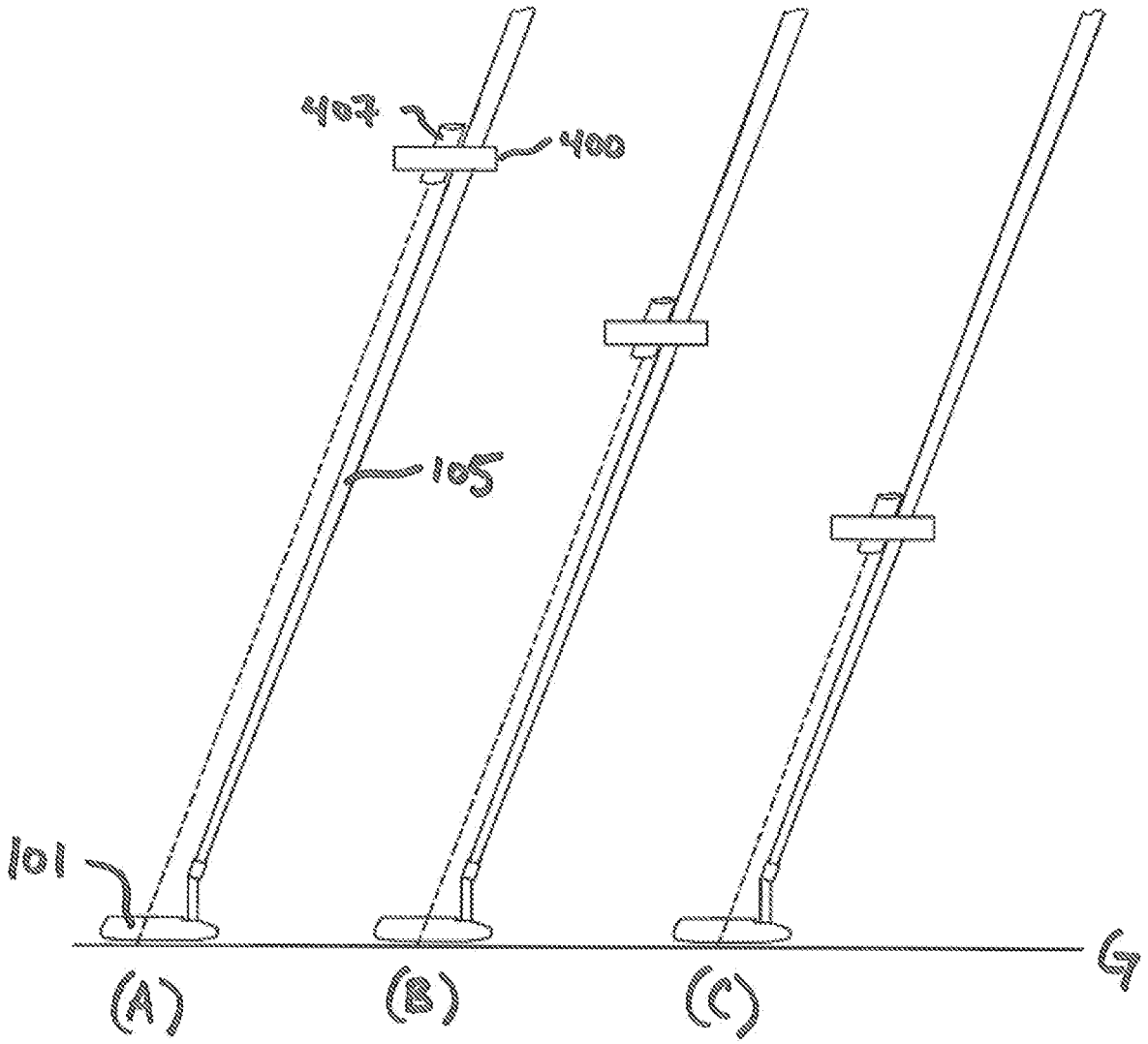
FIG. 10 shows a side view of a golf club fitting apparatus attached to a golf club in accordance with an exemplary embodiment of the present invention.
Figure 11:
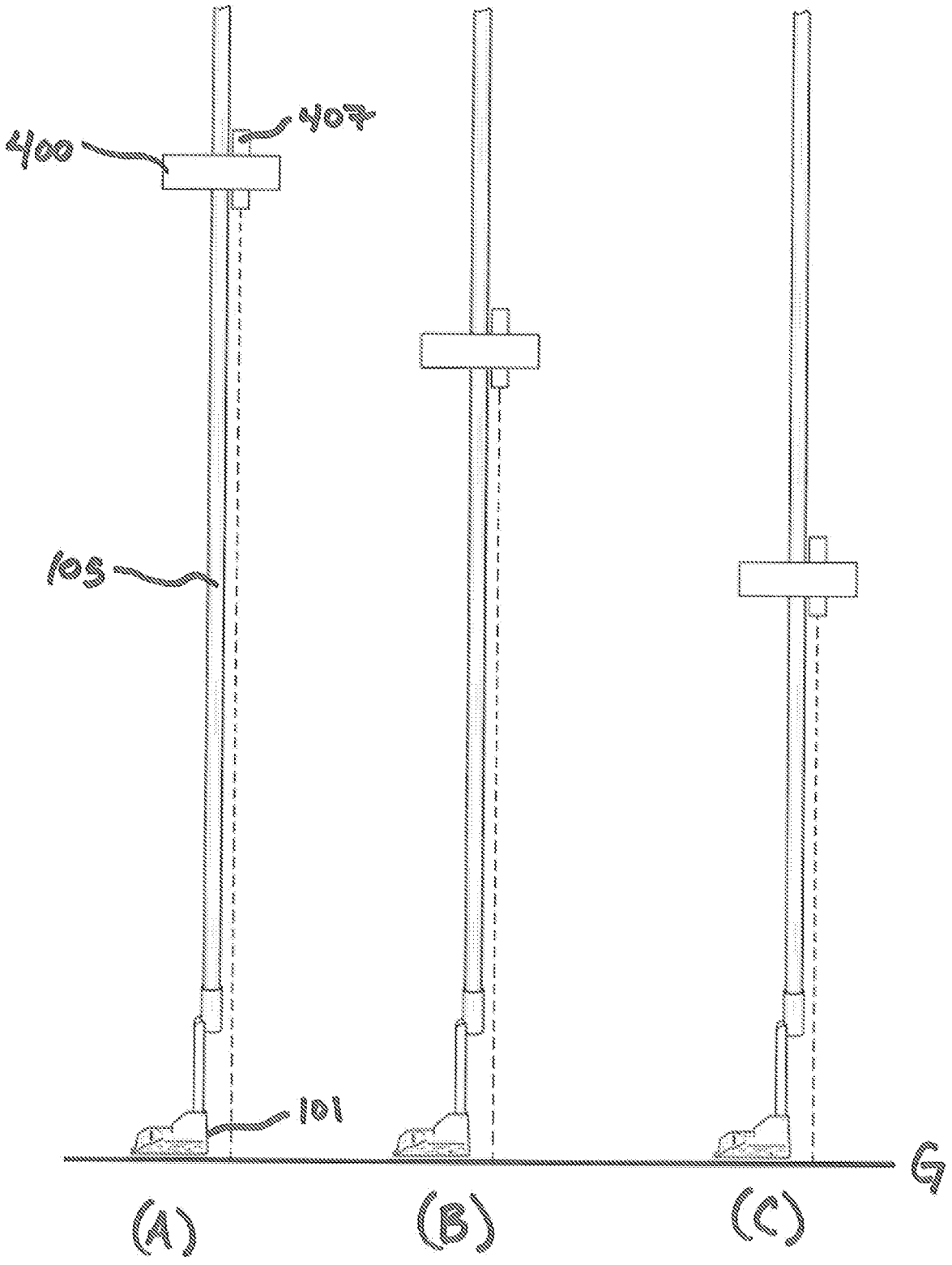
FIG. 11 shows a frontal view of a golf club fitting apparatus attached to a golf club in accordance with an exemplary embodiment of the present invention.

Referring to FIGS. 10 and 11, a golf club fitting apparatus 400 in accordance with the present invention is illustrated installed on a shaft 105 of a golf club. FIG. 10 is a frontal view of an installed golf club fitting apparatus 400 according to an embodiment of the present invention and FIG. 11 is a side view of the golf club fitting apparatus 400.

As a result of the unique construction of the golf club fitting apparatus 400, the golf club fitting apparatus 400 may be installed at any straight portion of a shaft 105. As shown in FIGS. 9 and 10, the golf club fitting apparatus is installed progressively lower on each of golf clubs (A), (B), and (C). However, despite the different configurations, an axis of the stroke-path indicator 407 intersects the ground plane G at substantially the same position. It is noted that putters may include different types of shafts having different bending profiles; however, regardless of the bending profile of the shaft, or the installation position on the shaft, the axis of the stroke-path indicator 407 will intersect the ground plane G at substantially the same position for a given putter. The point of intersection may also be moved slightly if the putter is held in a manner that deviates from the proper address position, which offers a further manner in which the golf club fitting apparatus 400 may assist to ensure that a putter is properly fitted.

Figure 12:
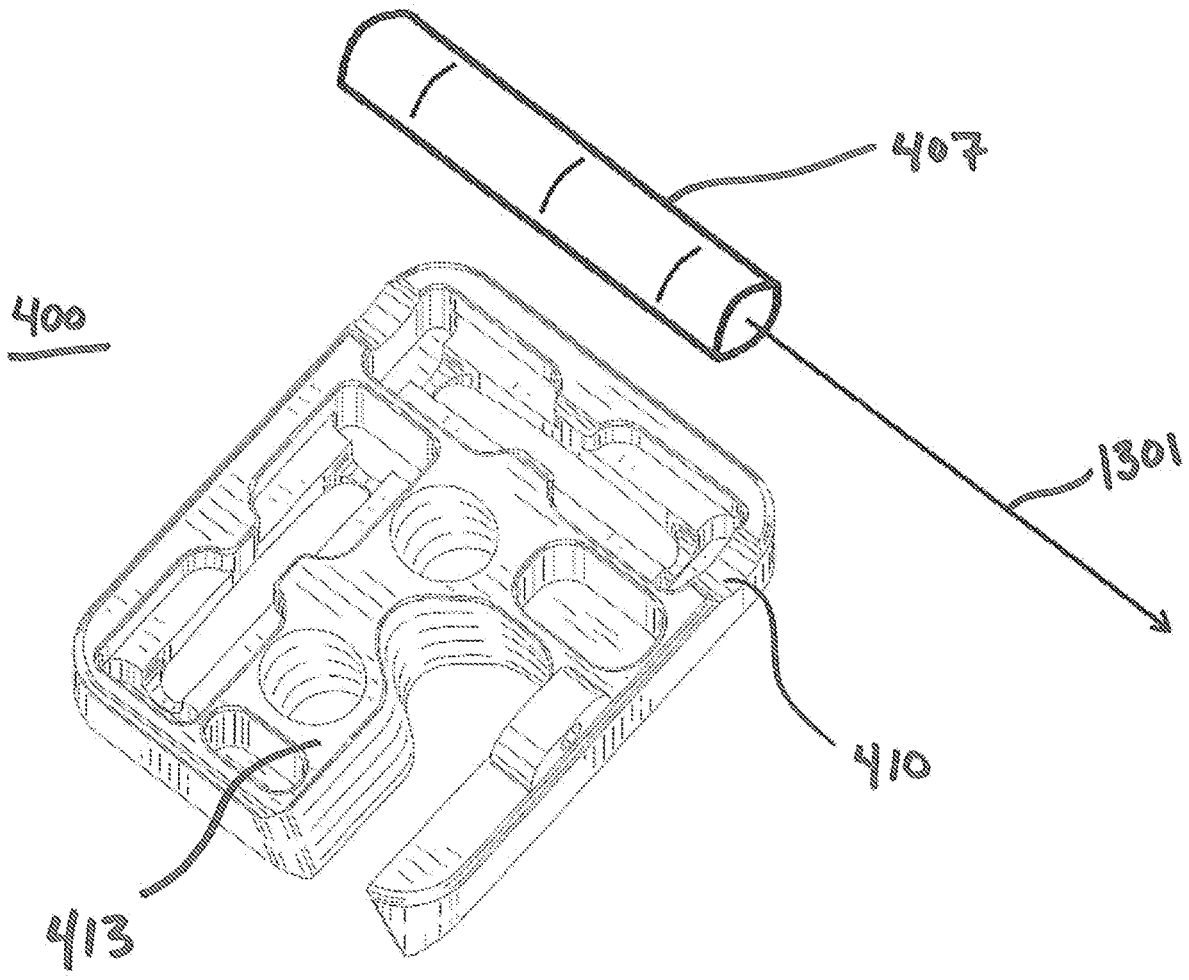
FIG. 12 shows an exploded perspective view of the bottom of a golf club fitting apparatus in accordance with an exemplary embodiment of the present invention.
Figure 13:
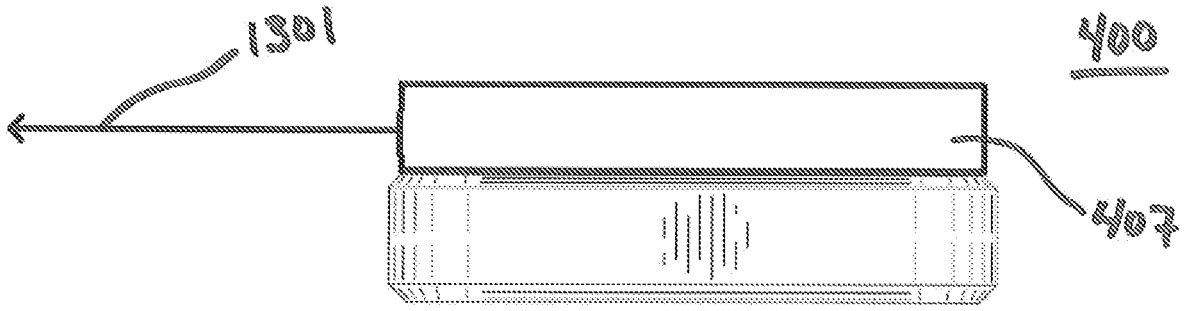
FIG. 13 shows a side view of a golf club fitting apparatus in accordance with an exemplary embodiment of the present invention.

Referring to FIGS. 12 and 13, the golf club fitting apparatus 400 is shown in a second configuration. In the second configuration, the golf club fitting apparatus 400 placed on a ground surface and a collimated light source is attached to the club fitting apparatus such that an axis passing through the center thereof is emitted substantially parallel to a ground plane G. The collimated light source may be the stroke-plane indicator 407 or may be a different collimated light source. Preferably, the collimated light source is the stroke-plane indicator 407 and it is disposed within a first groove 410 defined in a lower surface 413 of the golf club fitting apparatus 400 when the golf club fitting apparatus 400 is inverted as shown in FIGS. 12 and 13.

Figure 14:
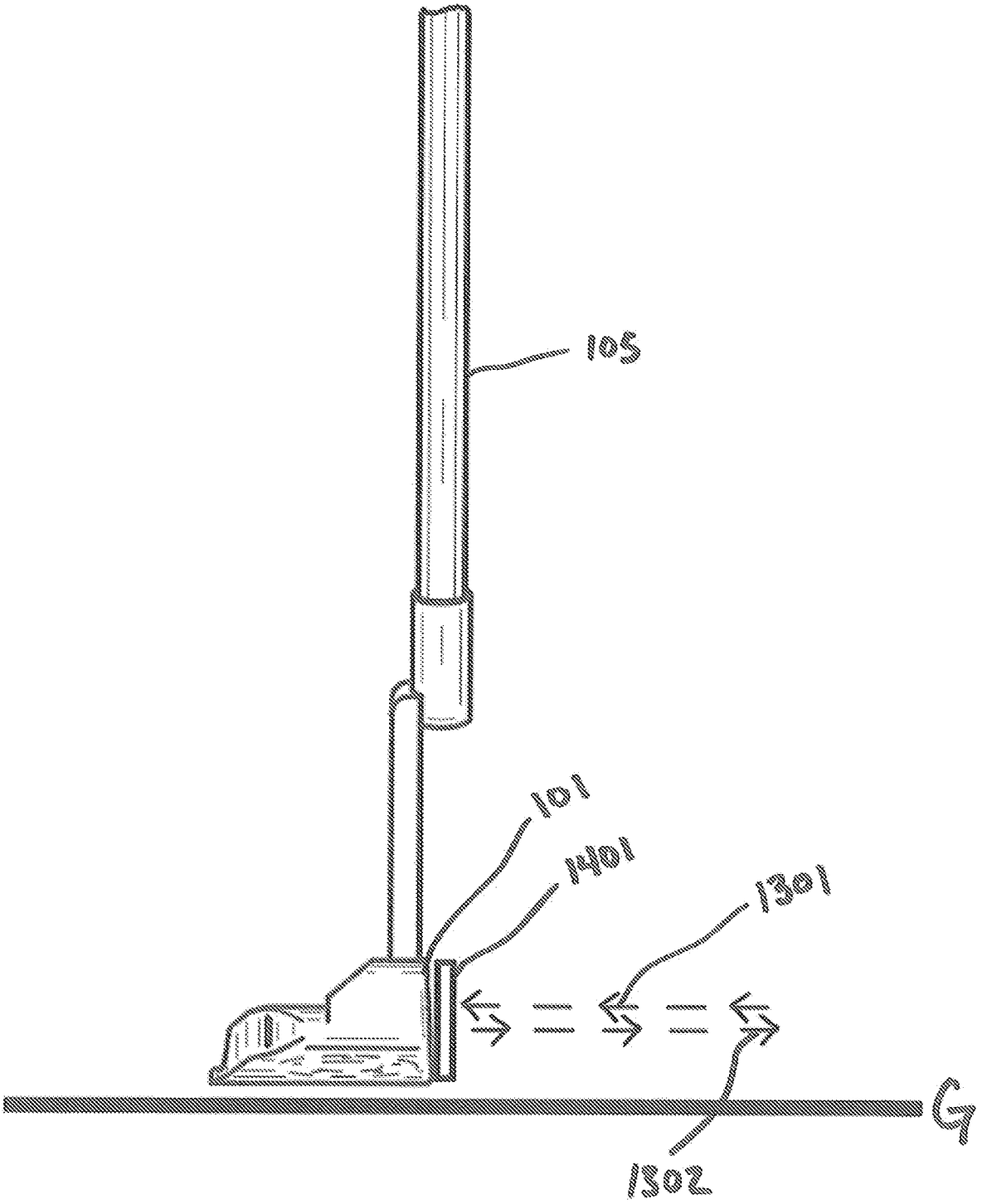
FIG. 14 shows a side view of a putter with a reflective member attached thereto used in conjunction with a golf club fitting apparatus in accordance with an embodiment of the present invention.

Referring to FIG. 14, the light emitted by the stroke-plane indicator 407 may be directed toward the striking face of the putter to ensure proper alignment of the putter with respect to the putting line. The stroke-plane indicator 407 is oriented perpendicular to the striking face of a putter head 104. The putter head 104 comprises a reflective surface 1401 attached to the striking face 101. The incident beam 1301 emitted by the stroke-plane indicator 407 strikes the reflective surface 1401 and is directed away from the reflective surface 1401 as a reflected beam 1302 back towards an indexed reference device, such as an opaque surface, such as a ruler or paper, a grid, such as graph paper, or a photo-detector, such as a charge-coupled device ("CCD"). The reflective surface 1401 can be any reflective surface, but is preferably a mirror or highly-polished fused silica of glass. A spacer or shim may also be used to orient the reflecting surface in the proper angle for return of the collimated light source to the reference device.

As a golfer addresses a golf ball prior to making a putting stroke, the reflected beam 1302 is directed back at the reference device. The location of the reflected beam 1302 on the reference device aids the golfer in determining the orientation of the putter face prior to making the putting stroke. For example, if the putter face of a right-handed putter is held in an "open" orientation, the laser beam spot will be reflected to the right of center on the reference device. Conversely, if the putter face of a right handed putter is held in a closed orientation, the laser beam spot will be reflected to the left of center on the reference device. Of course, if the putter face is square, the laser beam spot will be reflected directly to the center of the reference device.

The present invention is also directed to a method of fitting and aligning a golf club. The method includes providing a golf club having a head with a loft angle and a shaft extending from the head at a lie angle, attaching a golf club fitting apparatus to the shaft of the golf club, measuring an effective loft, an effective lie angle, and adjusting the length and/or positioning of the golf club based on the effective lie angle and effective loft. The method also includes swinging the club, using the golf club fitting apparatus to measure a swing-plane of the golf club, and adjusting the swing-plane in response to measured swing-plane. The method also includes aiming the golf club at a target, measuring the actual aim point of the golf club, and adjusting the aiming based on the measured aim point.

Figure 15:
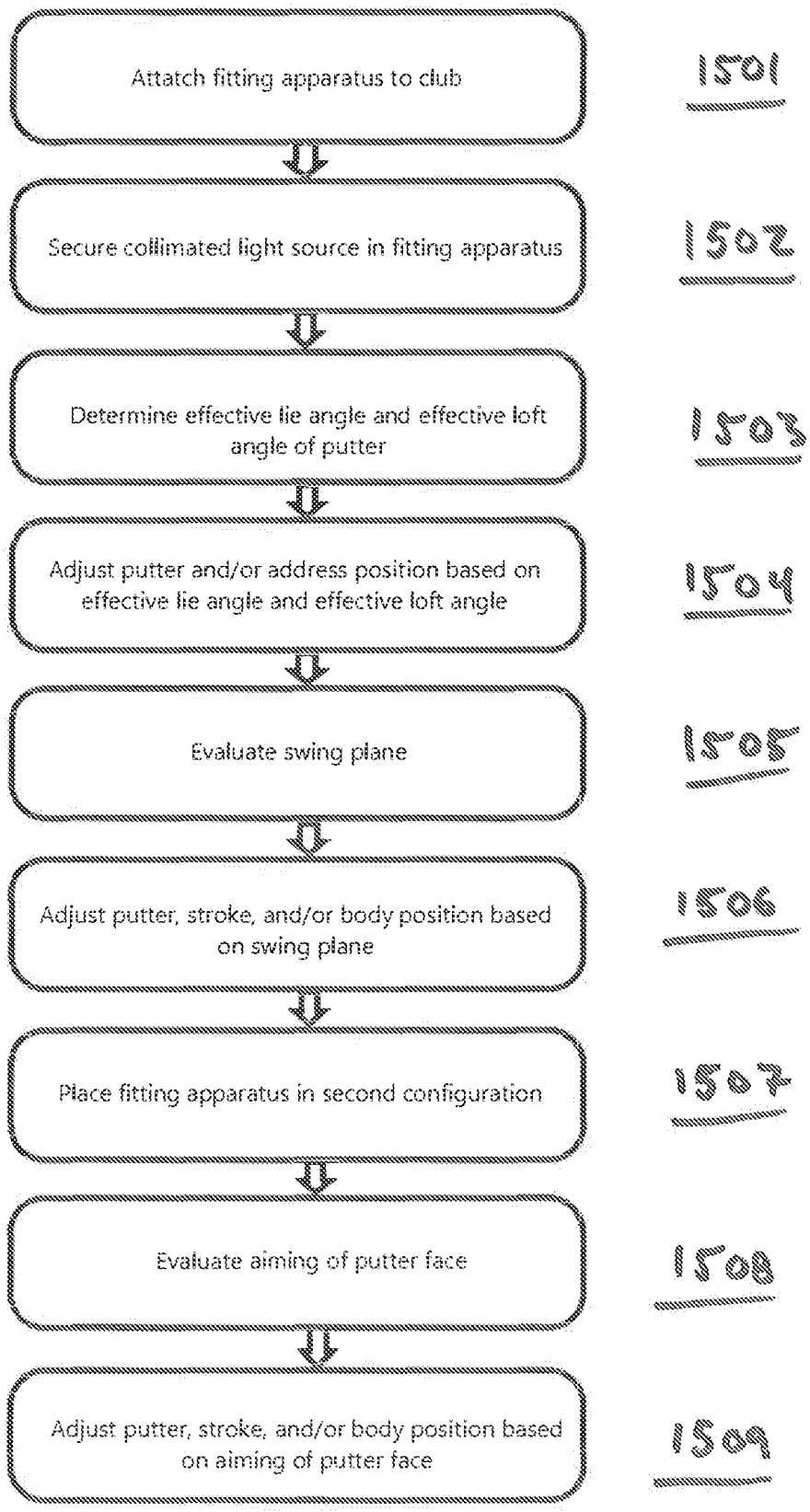
FIG. 15 shows a flowchart of a method of fitting a putter with a golf club fitting apparatus in accordance with an exemplary embodiment of the present invention.

Referring to FIG. 15, a flowchart diagram illustrates a preferred method of fitting and adjusting clubs in accordance with the present invention. The approach and technique indicated by the flowchart are sufficient to describe at least one implementation of the present method. However, other implementations of the method may utilize approaches and techniques from those shown. It should be understood that the steps of the method outlined in the flowchart are not limited to the order as recited, but rather these steps may be implemented in any order and still fall within in the scope of the present disclosure.

As shown in FIG. 15, first, 1501 a club fitting apparatus 400 is attached to the shaft 105 of a golf club. The club fitting apparatus 400 may be secured to the shaft 105 with a fastener. The golf club fitting apparatus 400 is positioned on the shaft 105 so that a leading edge (left edge in FIG. 8, right edge in FIG. 9) is substantially parallel to the leading edge of the striking face of the putter.

Next, 1502, a stroke-plane indicator 407 is secured in the golf club fitting apparatus. The stroke-plane indicator may be a collimated light source, such as a laser, that emits a collimated beam. The stroke-plane indicator 407 may be fitted differently based on whether the putter is right-handed or left-handed.

Next, 1503, the golf club is held in an address position and a first angle indicator 403 and a second angle indicator 404 are read to determine an effective lie angle and an effective loft angle of the putter. In detail, the first angle indicator 403 and the second angle indicator 404 may indicate deviations from the normal address position of putter.

Next, 1504, the positioning of the putter and/or the putter itself may be adjusted based on the readings in 1503. For example, if a reading of the first angle indicator 403 and the second angle indicator 404 show that at least one of the effective lie angle and the effective loft angle are not at the prescribed level, the putter may be repositioned to ensure that the effective lie angle and effective loft angle are at the prescribed level. Should a golfer be uncomfortable addressing the ball in a manner that ensures the effective lie angle and effective loft are at the prescribed level, the actual putter may be adjusted or replaced. The adjustment or replacement of the putter may include any of changing the lie angle of the putter, changing the loft angle of the putter, or changing the shaft length of the putter to ensure that the effective lie angle and effective loft angle are at the prescribed level.

Then, 1505, the swing-plane of the putter is evaluated. In detail, the stroke-plane indicator 407 is turned on and the light emitted therefrom is focused at or near an area in front of the striking face of the putter. While the light is being emitted from the stroke-plane indicator 407, the putter is swung as in use. As the putter is swung, the light emitted from the stroke-plane indicator 407 will indicate a swing-plane on the ground. Provided that the putter is swung on the proper plane, the path that the stroke-plane indicator 407 traces on the ground will be parallel to the intended target line. For example, as shown in FIG. 8, when the light emitted by the stroke-plane indicator 407 is focused on the target line 311 at address, a proper-arc-shaped path 310 will cause the stroke-plane indicator 407 to trace the target line 311 during the backswing and follow through. It is understood that depending on the type of shaft installed in the putter, the stroke-plane indicator 407 may focus at the target line, heelward of the target line, or toeward of the target line. Regardless of where the stroke-plane indicator 407 focuses, stroke-plane indicator 407 will trace a substantially straight line that is substantially parallel to the target line 311 when the stroke is on plane and follows the proper arc-shaped path 310.

Then, 1506, the stroke and/or the putter may be adjusted based on the trace of the stroke-plane indicator 407 in 1505. Many different adjustments may be made based on the trace, including moving a golfer's eye line, body alignment, grip, weight distribution, the geometry of the putter itself, etc.

Next, 1507, the golf club fitting apparatus 400 is removed from the shaft and placed on the ground. The stroke-plane indicator 407 is placed on the golf club fitting apparatus 400.

Then, 1508, while the stroke-plane indicator 407 is emitting light, the putter is placed in an address position such that that the stroke-plane indicator 407 emits light toward the striking face 101 of the putter 100. As a golfer addresses a golf ball prior to making a putting stroke, the beam emitted from the stroke-plane indicator 407 is directed back at a reference device. The location of the reflected beam of light on the reference device aids the golfer in determining the orientation of the putter face prior to making the putting stroke. For example, if a right handed putter face is held in an "open" orientation, the laser beam spot will be reflected to the right of center on the reference device. Conversely, if the putter face of a right handed putter is held in a closed orientation, the laser beam spot will be reflected to the left of center on the reference device. Of course, if the putter face is square, the laser beam spot will be reflected directly to the center of the reference device.

Then, 1509, the setup position and/or putter may be adjusted based on the how the laser beam spot is reflected. These adjustments may include moving a golfer's eye line, body alignment, grip, weight distribution, the geometry of the putter itself, etc.

Figure 16:
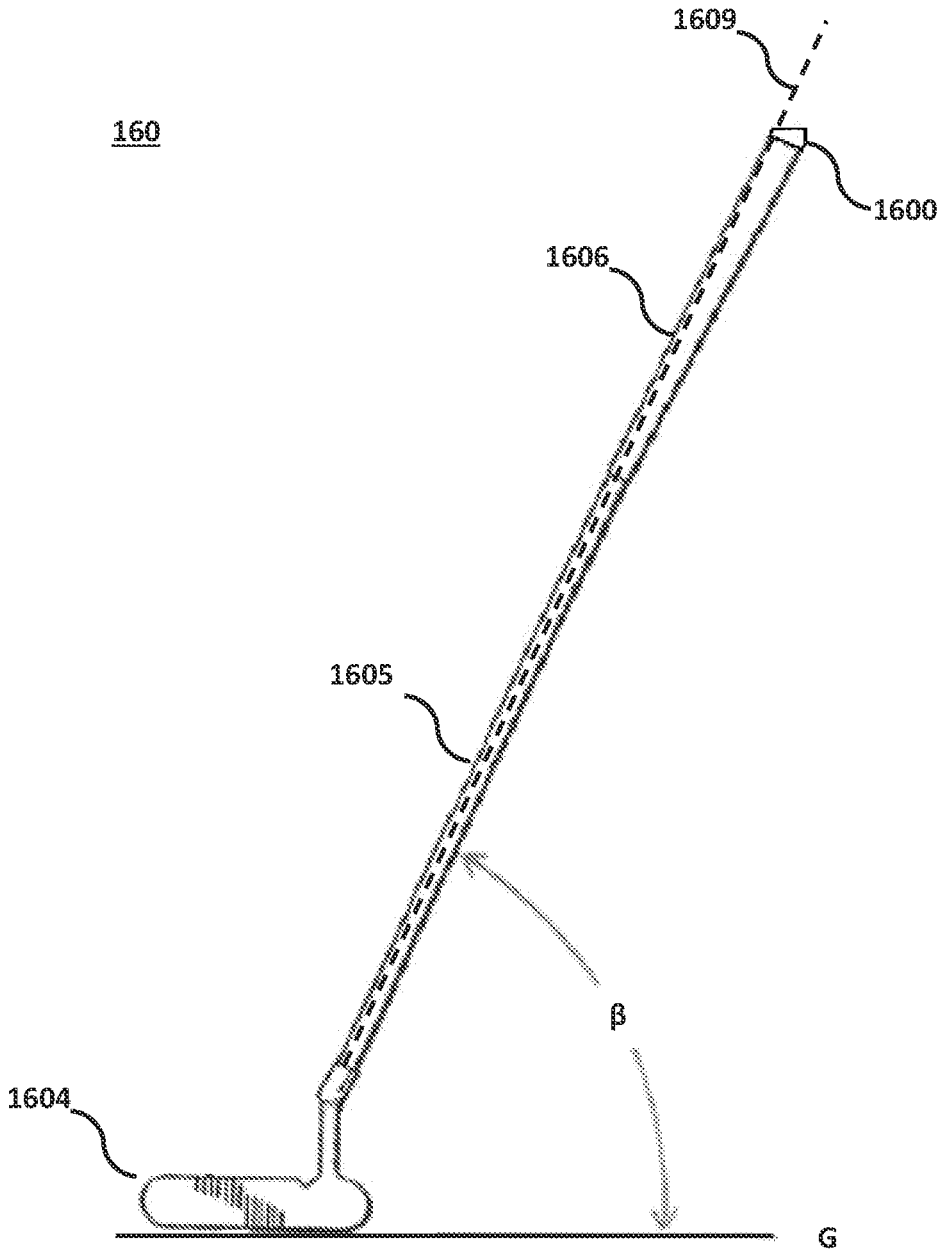
FIG. 16 shows a side view of a golf club fitting apparatus attached to a golf club in accordance with an exemplary embodiment of the present invention.
Figure 17:
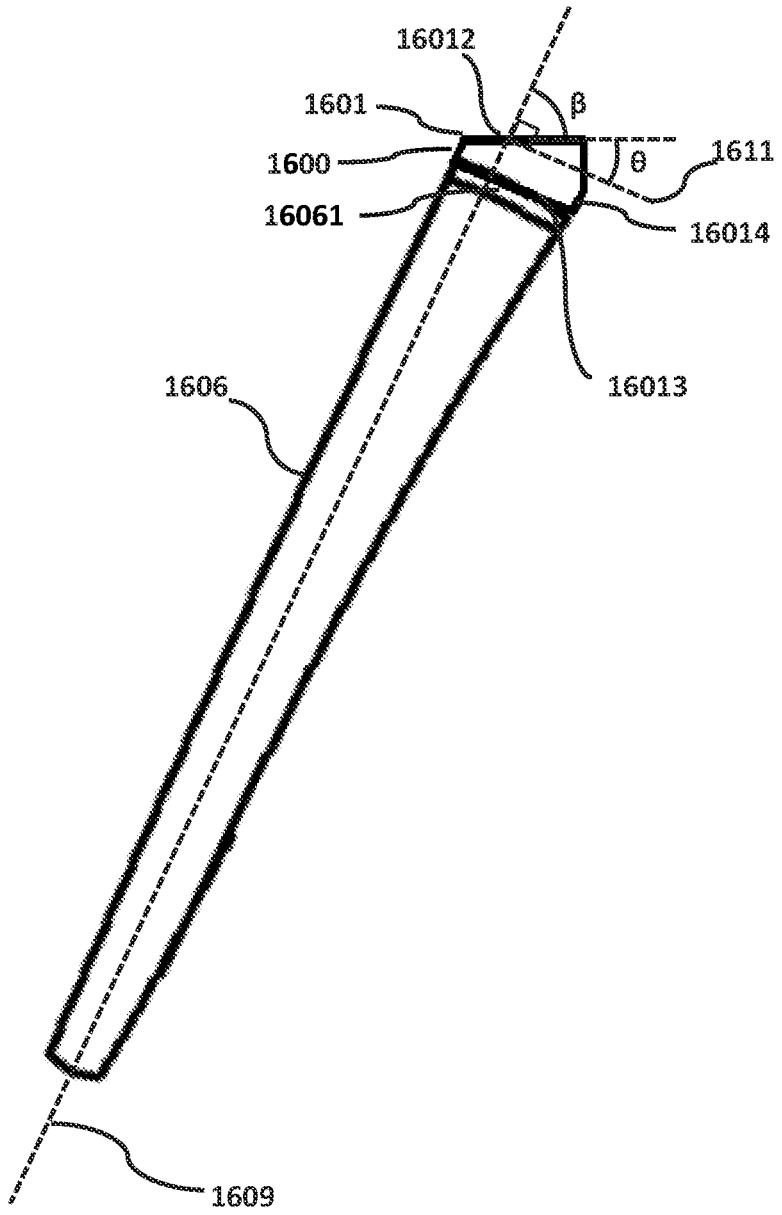
FIG. 17 shows a side view of a golf club fitting apparatus attached to a grip in accordance with an exemplary embodiment of the present invention.
Figure 18:
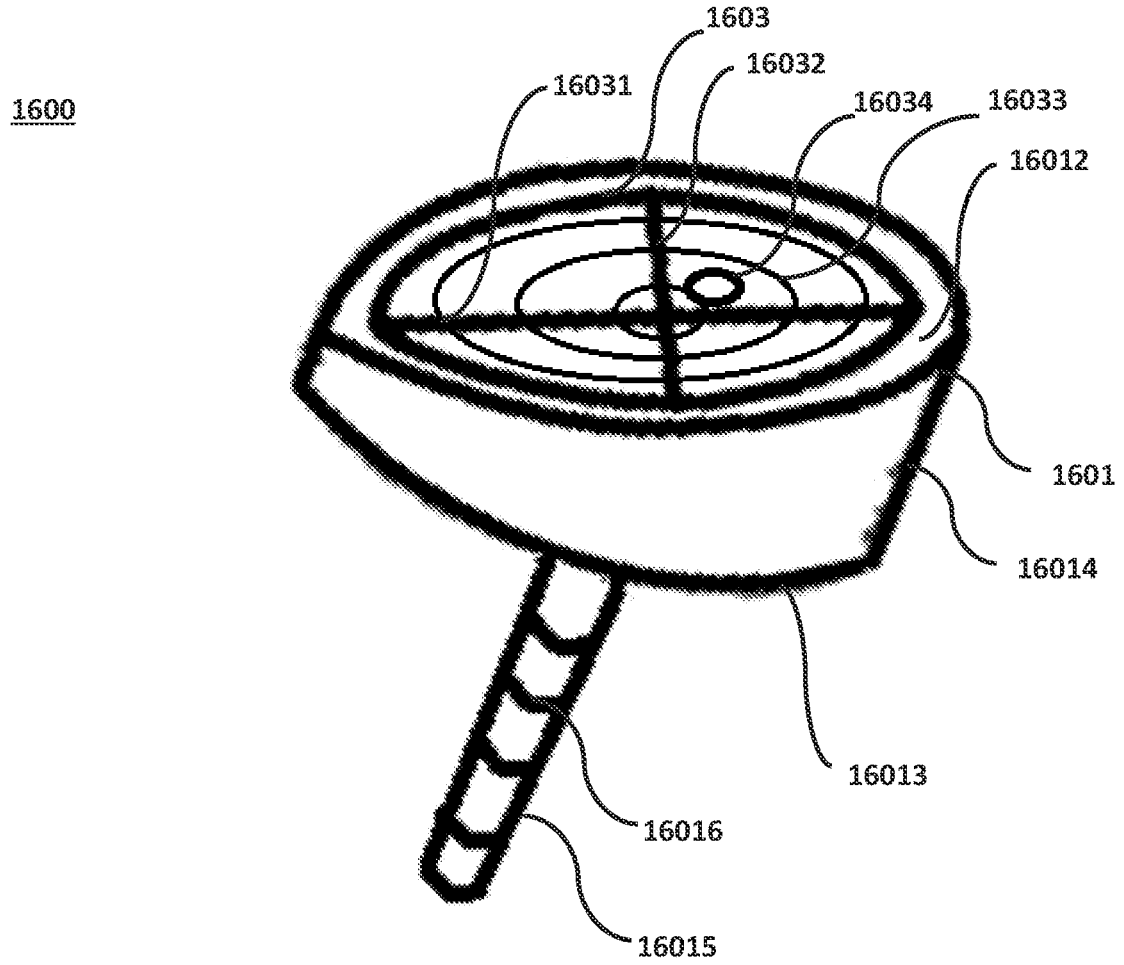
FIG. 18 shows a perspective view of a golf club fitting apparatus in accordance with an exemplary embodiment of the present invention.

Referring to FIGS. 16-18, a golf club fitting apparatus in accordance with an embodiment of the present invention is disclosed. FIG. 16 is side view of a golf club fitting apparatus attached to a grip of a golf club, FIG. 17 is a side view of the grip and the golf club fitting apparatus, FIG. 18 is a perspective view of the golf club fitting apparatus attached to the grip of the golf club.

As shown in FIG. 16, a putter 160 includes a putter head 1604. A shaft 1605 is attached to the putter head 1604. A shaft axis 1609 extends from the putter head 1604 through a center of the shaft 1605. When the putter 160 is held in a normal address position (e.g., held such that the putter's prescribed loft angle and lie angle are equal to the putter's effective loft angle and effective lie angle), the shaft axis 1609 is disposed at a lie angle β relative to a ground plane G. A grip 1606 is attached to the end of the shaft 1605 opposite the putter head 1604. A golf club fitting apparatus 1600 is attached to the putter 160 at a butt end of the grip 1606.

Referring to FIG. 17, the grip 1606 and the golf club fitting apparatus 1600 attached thereto are shown in greater detail to elaborate some of the unique features of the golf club fitting apparatus 1600.

As shown in FIG. 17, the grip 1606 includes a butt end 16061 at a terminal end thereof. The butt end 16061 of the grip 1606 may be formed at any angle relative to the shaft axis 1609, but preferably the butt end 16061 of the grip 1606 is formed substantially perpendicular to the shaft axis 1609. The golf club fitting apparatus 1600 includes a second apparatus body 1601. The second apparatus body 1601 may be formed of metal, wood, plastic, or composites. According to an exemplary embodiment, the second apparatus body 1601 of the golf club fitting apparatus 1600 may be formed of anodized 6061 aluminum.

The second apparatus body 1601 includes a lower surface 16013, an upper surface 16012 opposite the lower surface 16013, and a lateral surface 16014 connecting the lower surface 16013 and the upper surface 16012. The lower surface 16013 of the second apparatus body 1601 may be in contact with a butt end 16061 of the grip 1606 when the golf club fitting apparatus 1600 is attached thereto. According to an embodiment of the present invention, the lower surface 16013 and the butt end 16061 of the grip 1606 may be configured to substantially conform to each other such that a transition from the grip 1606 to the golf club fitting apparatus 1600 is substantially seamless.

As shown in FIG. 17, the lower surface 16013 and the upper surface 16012 of second apparatus body 1601 may be formed so as to be angularly offset from each other. That is, the lower surface 16013 of the second apparatus body 1601 may be substantially parallel to the butt end 16061 of the grip 1606 and the upper surface 16012 of the second apparatus body 1601 may be substantially parallel to the ground plane G when the putter 160 is held in a normal address position.

While the lower surface 16013 and the upper surface 16012 of the second apparatus body 1601 may be offset from each other, the critical dimension is actually the first angle θ between the upper surface 16012 of the second apparatus body 1601 and a plane 1611 extending normal to the shaft axis 1609. According to an embodiment of the present invention, the first angle θ may be between about 0° to about 30°, preferably the first angle θ may be about 15° to about 25°, and most preferably the first angle θ may be about 20° and complementary to the lie angle β.

When the first angle θ is in this range, the upper surface 16012 of the second apparatus body 1601 is substantially parallel to the ground plane G when the putter 160 is held in the normal address position.

It is worth noting here that the first angle θ is the same as the first angle θ described above with regard to FIG. 7. While the first angle θ is shown in FIG. 16 is measured with respect to the shaft axis 1609 rather than the lower surface 413 of the golf club fitting apparatus 400, the first angle θ ultimately controls the orientation of the golf club fitting apparatus 400 and golf club fitting apparatus 1600 relative to the ground plane G in the same manner.

It is noted that the shaft axis 1609 may not pass precisely through the center of the grip 1606. According to the rules of golf, a putter grip may be non-symmetrical. For example, as shown in FIG. 17 the grip 1606 may have a pistol shape where the circumference of the grip 1606 is greatest near the butt end 16061, and near the butt end 16061 a larger percentage of the grip 1606 is located on the underside of the grip 1606 from the perspective of a golfer.

Referring to FIG. 18, a perspective view of the golf club fitting apparatus 1600 allows for several additional features to be more clearly illustrated. As shown in FIG. 18, an angle indicator 1603 is coupled to the second apparatus body 1601 and is exposed on the upper surface 16012 of the second apparatus body 1601. The angle indicator 1603 may be secured to the second apparatus body 1601 by press fitting, snap fitting, adhesion, mechanical fastening, or the like.

The angle indicator 1603 may further include a level indicator 16034. The angle indicator 1603 may be any angle indicator, including but not limited to a bubble level, a tilt sensor, a tilt indicator, a slope meter, a slope gauge, a gradient meter, a gradiometer, a level gauge, and a level meter.

Preferably the level indicator 16034 is a ball or a bubble configured to move about the angle indicator 1603 to indicate both effective loft angle and effective lie angle of the putter 160.

The angle indicator 1603 is configured to indicate both the effective loft angle and the effective lie angle of a putter. The angle indicator 1603 may further include markings 16033 defined thereon to provide a scale for measuring the effective lie angle and the effective loft angle of the putter 160 when held at address. The markings 16033 may be formed by any suitable manner, including but not limited to etching, molding, printing, or painting onto the angle indicator 1603.

According to an exemplary embodiment, as shown in FIG. 18 the markings 16033 may include a first axis 16031 and a second axis 16032. The first axis 16031 may be oriented such that an imaginary vertical plane including the first axis 16031 extends parallel a leading edge of the striking face of a putter 160 when the golf club fitting apparatus 1600 is attached thereto. The second axis 16032 may be perpendicular to the first axis 16031 such that an imaginary vertical plane including the second axis 16032 extends parallel to an aiming line when the golf club fitting apparatus 1600 is attached to the putter 160.

The intersection of the first axis 16031 and the second axis 16032 represent a neutral position of the putter 160 where the effective lie angle and the effective loft angle are equal to the prescribed lie angle and the prescribed loft angle, respectively. When the level indicator 16034 is located at the intersection of the first axis 16031 and the second axis 16032, it can be said that the putter 160 is positioned in the normal address position and exhibits both the prescribed lie angle and the prescribed loft angle.

Movement of the level indicator 16034 along the first axis 16031 corresponds to changes in the effective lie angle of the putter 160. Movement of the level indicator 16034 along the second axis 16032 corresponds to changes in the effective loft angle of the putter 160. Movement of the level indicator 16034 in other directions therefore corresponds to changes in both the effective loft angle and the effective lie angle of the putter 160.

By way of example, the level indicator 16034 as depicted in FIG. 18 is not centered about the intersection of the first axis 16031 and the second axis 16032. From the perspective of a golfer, the level indicator 16034 in FIG. 18 deviates from the second axis 16032 and is therefore positioned such that an effective lie angle of the putter is too great (i.e., the putter is being held too upright). The level indicator 16034 also deviates from the first axis 16031 and is therefore positioned such that the effective loft angle is too small (i.e., the putter is being overly forward-pressed such that the grip is being moved too close to the target).

By adjusting the address position of the putter 160 to center the level indicator 16034 about the intersection of the first axis 16031 and the second axis 16032 the putter 160 may be consistently positioned in the normal address position. By practicing positioning the putter 160 in this manner, a golfer may become more proficient in consistently and accurately addressing the golf ball. As detailed above, even a fraction of a degree of deviation from the normal address position can lead to missed putts. Therefore, the golf club fitting apparatus 1600 may go a long way to improving a golfer's setup and therefore their performance.

As shown in FIG. 18, in addition to or alternative to the first axis 16031 and the second axis 16032, the markings 16033 may include one or more concentric circles centered about the point of intersection of the first axis 16031 and the second axis 16032. As another example, the markings 16033 may include a grid centered about the intersection of the first axis 16031 and the second axis 16032 or a series of discrete marks disposed along the first axis 16031 and the second axis 16032. As yet another example, the markings 16033 may include a single point corresponding to the point of intersection of the first axis 16031 and the second axis 16032.

The markings 16033 of the angle indicator 1603 may be configured to indicate a range of deviations from the normal address position both in terms of lie angle and loft angle of between about −10 degrees to about 10 degrees, preferably between about −5 degrees to about 5 degrees, and most preferably between about −3 degrees to about 3 degrees.

Another feature of the present invention that is more clearly shown in FIG. 18 is the projection 16015 which extends from the lower surface 16013 of second apparatus body 1601. The projection 16015 is configured to secure the golf club fitting apparatus 1600 to the butt end 16061 of a grip 1606. The projection 16015 may have a tapered or constant diameter, and may include one or more ribs 16016 having an increased diameter relative to adjacent portions of the projection 16015. The projection 16015 is dimensioned so as to securely fit within a hole formed on the butt end 16061 of conventional golf grips such as grip 1606.

Though not shown in the drawings, according to an alternative embodiment of the present invention, a first magnet may be fixedly attached to the lower surface 16013 of the second apparatus body 1601 and a second magnet may be attached to or formed integrally with a butt end 16061 of a grip 1606. The first and second magnets may have opposite polarities such that the golf club fitting apparatus 1600 may be removably coupled to the butt end 16061 of the grip 1606 via a magnetic force.

According to a further alternative embodiment, the golf club fitting apparatus 1600 may be removably coupled to the butt end 16061 of the grip 1606 using an adhesive or a mechanical fastener such as a screw.

According to embodiments of the present invention, the golf club fitting apparatus may be quickly and easily installed onto a golf club for use during practice, as the rules of golf do not allow for movable components to be attached to golf clubs during play. The configuration of the golf club fitting apparatus, specifically the angular offset between the upper and lower surfaces of the second apparatus body, offsets the lie angle of the golf club such that the angle indicator may be centered relative to the ground when installed. The centered position of the angle indicator results in accurate and consistent installation and therefore accurate and consistent measurements of both effective loft angle and effective lie angle by the angle indicator. As a result, the golf club fitting apparatus according to embodiments of the present invention can uniquely improve a golfer's accuracy and consistency in setup, and therefore a golfer's accuracy and consistency in play.

The present invention is also directed to a method of fitting a golf club. The method includes providing a golf club having a head with a loft angle and a shaft extending from the head at a lie angle, attaching a golf club fitting apparatus to the grip of the golf club, measuring an effective loft angle, an effective lie angle, and adjusting the length and/or positioning of the golf club based on the effective lie angle and effective loft angle.

Figure 19:
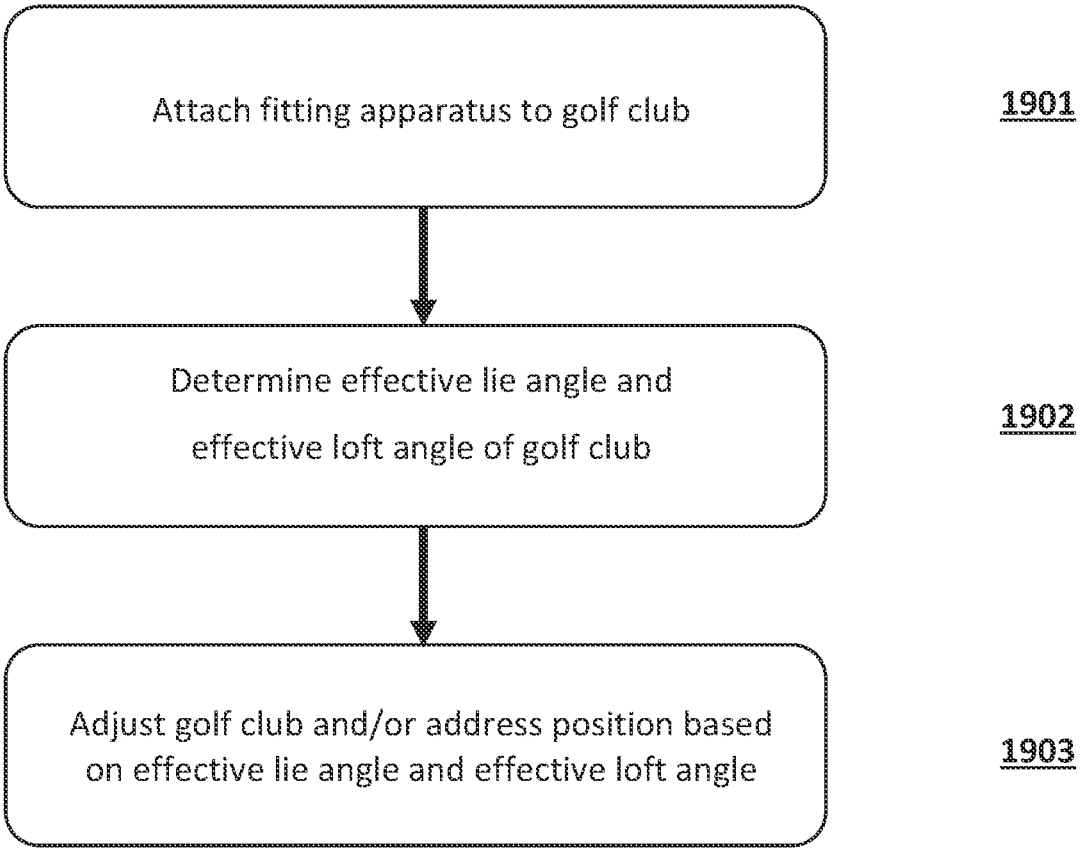
FIG. 19 shows a flowchart of a method of fitting a putter with a golf club fitting apparatus in accordance with an exemplary embodiment of the present disclosure.

Referring to FIG. 19, a flowchart diagram illustrates a preferred method of fitting and adjusting clubs in accordance with the present invention. The approach and technique indicated by the flowchart are sufficient to describe at least one implementation of the present method. However, other implementations of the method may utilize approaches and techniques different from those shown. It should be understood that the steps of the method outlined in the flowchart are not limited to the order as recited, but rather these steps may be implemented in any order and still fall within in the scope of the present disclosure.

As shown in FIG. 19 and with reference to the golf club fitting apparatuses of FIGS. 16-18, first, 1901 a club fitting apparatus 1600 is attached to grip 1606 of a putter 160. The club fitting apparatus 1600 may be secured to the grip 1606 with a projection 16015, an adhesive, or another mechanical fastener as described in detail above. The golf club fitting apparatus 1600 is positioned on the butt end 16061 of the grip 1606 such that the upper surface 16012 of the second apparatus body 1601 is parallel to the ground when the putter 160 is held in a normal address position.

Next, 1902, the putter 160 is held in an address position and angle indicator 1603 is read to determine an effective lie angle and an effective loft angle of the putter 160. In detail, angle indicator 1603 may indicate deviations from the normal address position of the putter 160.

Next, 1903, the positioning of the putter 160 and/or the putter 160 itself may be adjusted based on the readings in 1902. For example, if a reading of the angle indicator 1603 shows that at least one of the effective lie angle and the effective loft angle are not at the prescribed level, the putter 160 may be repositioned to ensure that the effective lie angle and effective loft angle are at the prescribed level. Should a golfer be uncomfortable addressing the ball in a manner that ensures the effective lie angle and effective loft are at the prescribed level, the actual putter 160 may be adjusted or replaced. The adjustment or replacement of the putter 160 may include any of changing the lie angle of the putter 160, changing the loft angle of the putter 160, or changing the shaft length of the putter 160 to ensure that the effective lie angle and effective loft angle are at the prescribed level.

Figure 20:
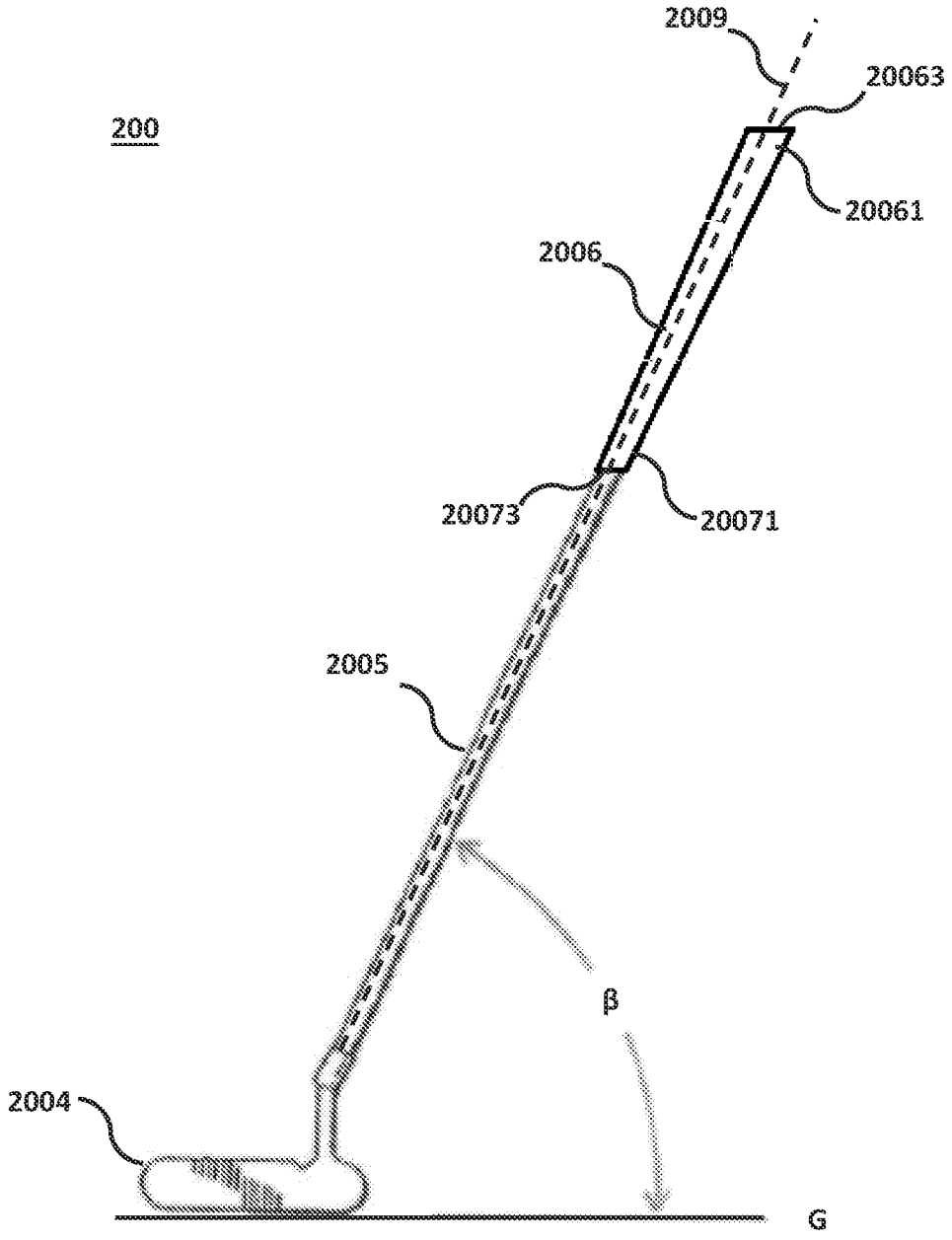
FIG. 20 shows a side view of a grip attached to a golf club in accordance with an exemplary embodiment of the present invention.
Figure 21:
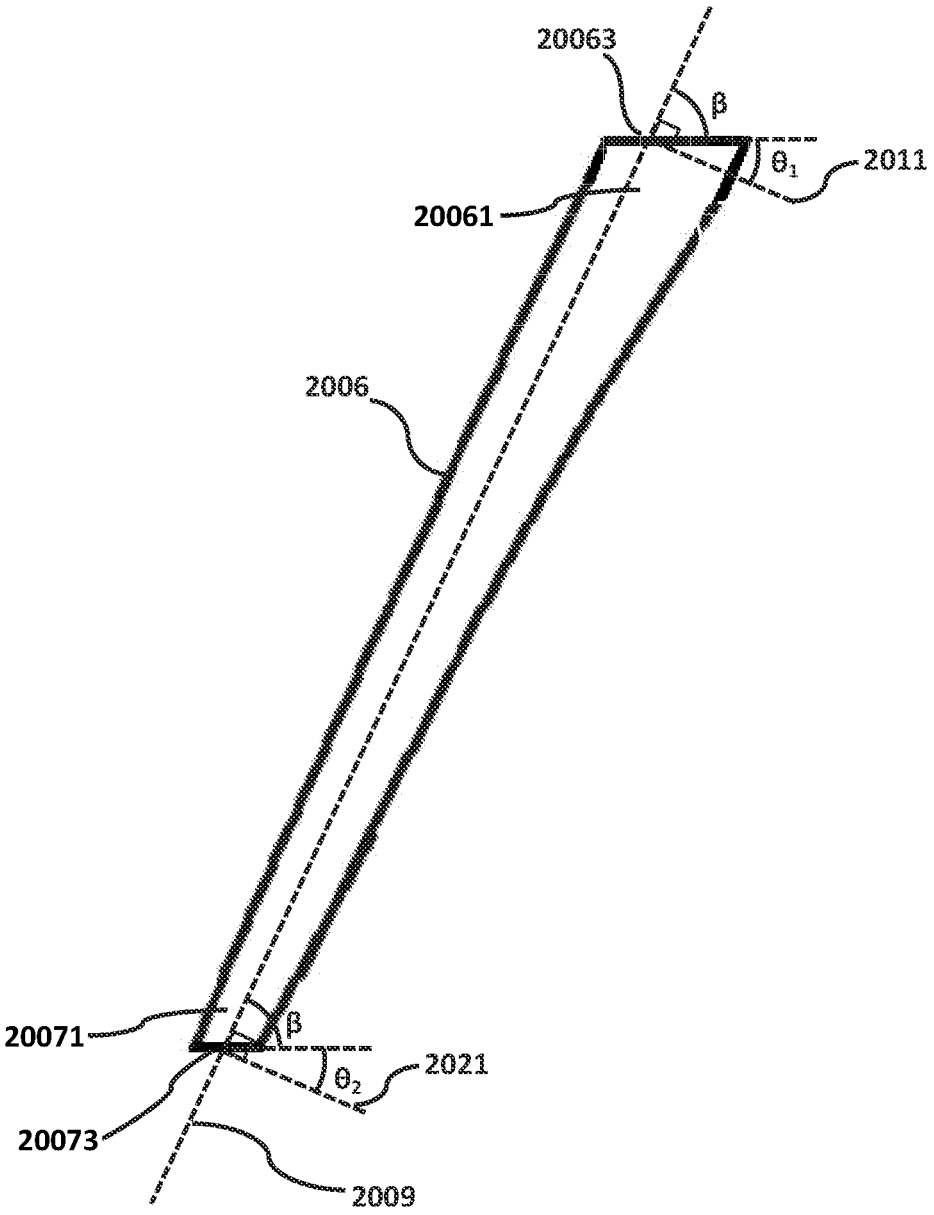
FIG. 21 shows a side view of a grip in accordance with an exemplary embodiment of the present invention.

Referring to FIGS. 20 and 21, a grip in accordance with an embodiment of the present invention is disclosed which aids in golf club fitting. FIG. 20 is a side view of the grip attached to a golf club in a normal address position, FIG. 21 is a side view of the grip.

As shown in FIG. 20, a putter 200 includes a putter head 2004. A shaft 2005 is attached to the putter head 2004. A shaft axis 2009 extends from the putter head 2004 through a center of the shaft 2005. When the putter 200 is held in a normal address position (e.g., held such that the putter's prescribed loft angle and lie angle are equal to the putter's effective loft angle and effective lie angle), the shaft axis 2009 is disposed at a lie angle $\beta$ relative to a ground plane G. A grip 2006 is attached to the end of the shaft 2005 opposite the putter head 2004. The grip 2006 includes a butt end 20061 adjacent to a terminal portion of the shaft 2005 and a distal end 20071 opposite the butt end 20061. The butt end 20061 has a top surface 20063 which is substantially planar. The distal end 20071 of the grip 2006 has a bottom surface 20073 which is substantially planar.

Referring to FIG. 21, the grip 2006 is shown in greater detail to elaborate some of the unique features of the grip 2006.

As shown in FIG. 21, the grip 2006 includes the butt end 20061 at a terminal end thereof. The top surface 20063 of the butt end 20061 is formed at an angle relative to a plane 2011 extending normal to the shaft axis 2009. The bottom surface 20073 of the distal end 20071 may be formed at an angle relative to a plane 2021 extending normal to the shaft axis 2009. The top surface 20063 of the butt end 20061 may be substantially parallel to the ground plane G when the putter 200 is held in a normal address position, and the bottom surface 20073 of the distal end 20071 may be substantially parallel to the ground plane G when the putter 200 is held in a normal address position. The top surface 20063 of the butt end 20061 provides a visual indication as to the effective lie angle and the effective loft angle of the putter head 2004. Likewise, the bottom surface 20073 of the distal end 20071 provides a visual indication as to the effective lie angle and the effective loft angle of the putter head 2004.

When the top surface 20063 of the butt end 20061 and/or the bottom surface 20073 of the distal end 20071 are parallel to the ground plane G, it can be said that the putter 200 is positioned in the normal address position and exhibits both the prescribed lie angle and the prescribed loft angle.

Referring to FIG. 21, the critical dimension is a first angle $\theta_1$ between the top surface 20063 of the butt end 20061 and the plane 2011 extending normal to the shaft axis 2009. According to an embodiment of the present invention, the first angle $\theta_1$ may be between about 10° to about 30°, preferably the first angle $\theta_1$ may be about 15° to about 25°, and most preferably the first angle $\theta_1$ may be about 20° and complementary to the lie angle $\beta$.

When the first angle $\theta_1$ is in this range, the top surface 20063 of the butt end 20061 is substantially parallel to the ground plane G when the putter 200 is held in the normal address position.

The bottom surface 20073 of the distal end 20071 of the grip 2006 may be oriented such that a second angle $\theta_2$ is formed between the bottom surface 20073 of the distal end 20071 of the grip 2006 and a plane 2021 extending normal to the shaft axis 2009. According to an embodiment of the present invention, the second angle $\theta_2$ may be between about 10° to about 30°, preferably the second angle $\theta_2$ may be about 15° to about 25°, and most preferably the second angle $\theta_2$ may be about 20° and complementary to the lie angle β. The top surface 20063 of the butt end 20061 and the bottom surface 20073 of the distal end 20071 may thus be parallel to each other.

Figure 22:
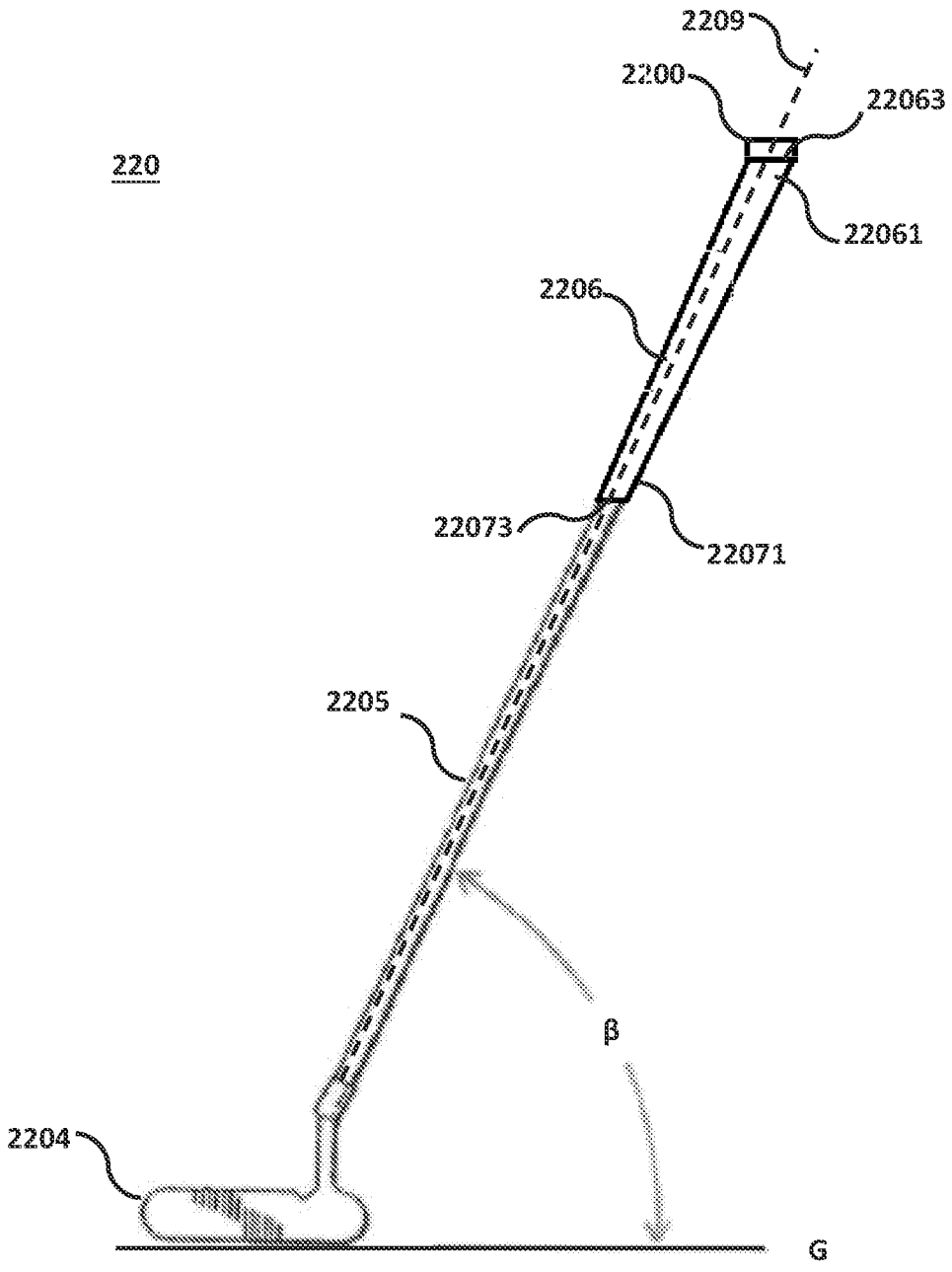
FIG. 22 shows a side view of a golf club fitting apparatus attached to a golf club in accordance with an exemplary embodiment of the present invention.
Figure 23:
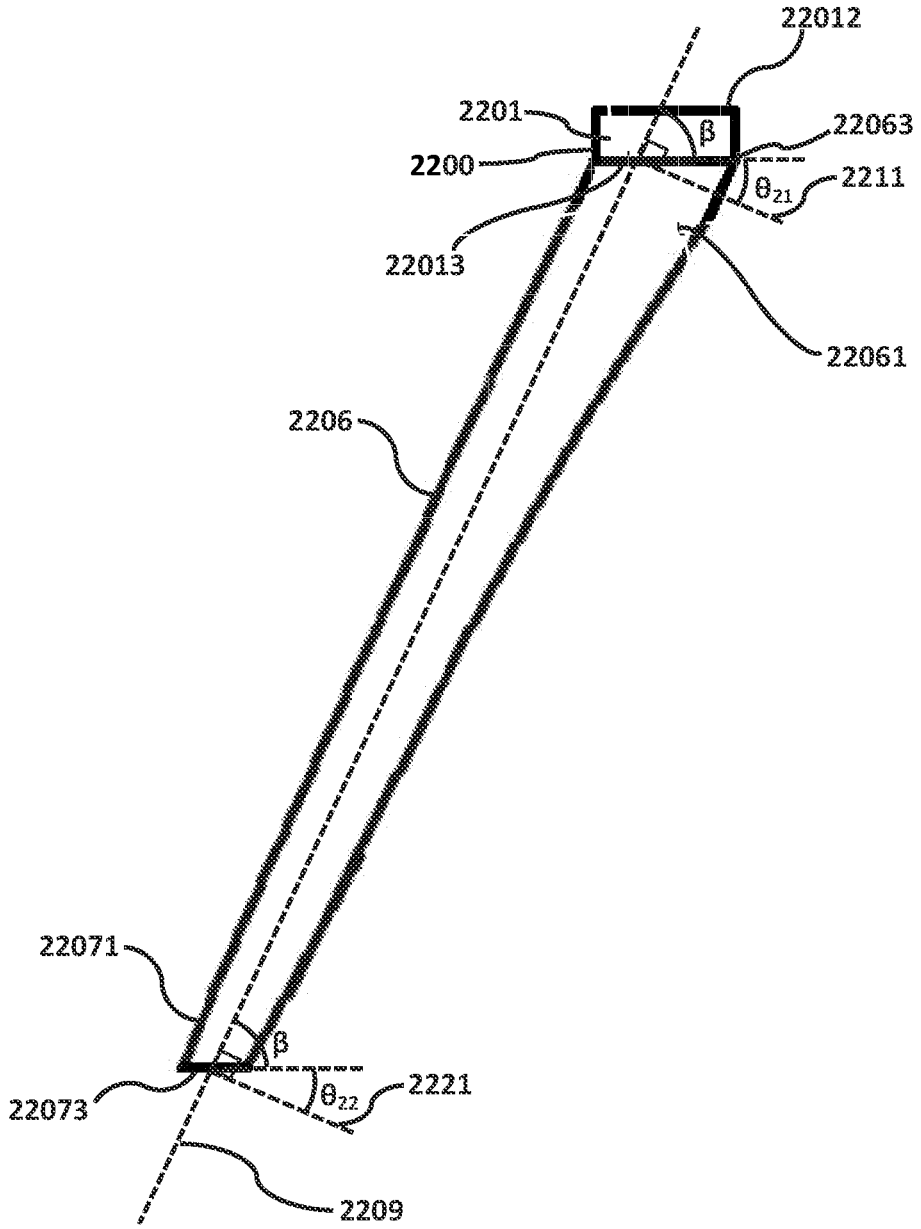
FIG. 23 shows a side view of a golf club fitting apparatus attached to a grip in accordance with an exemplary embodiment of the present invention.
Figure 24:
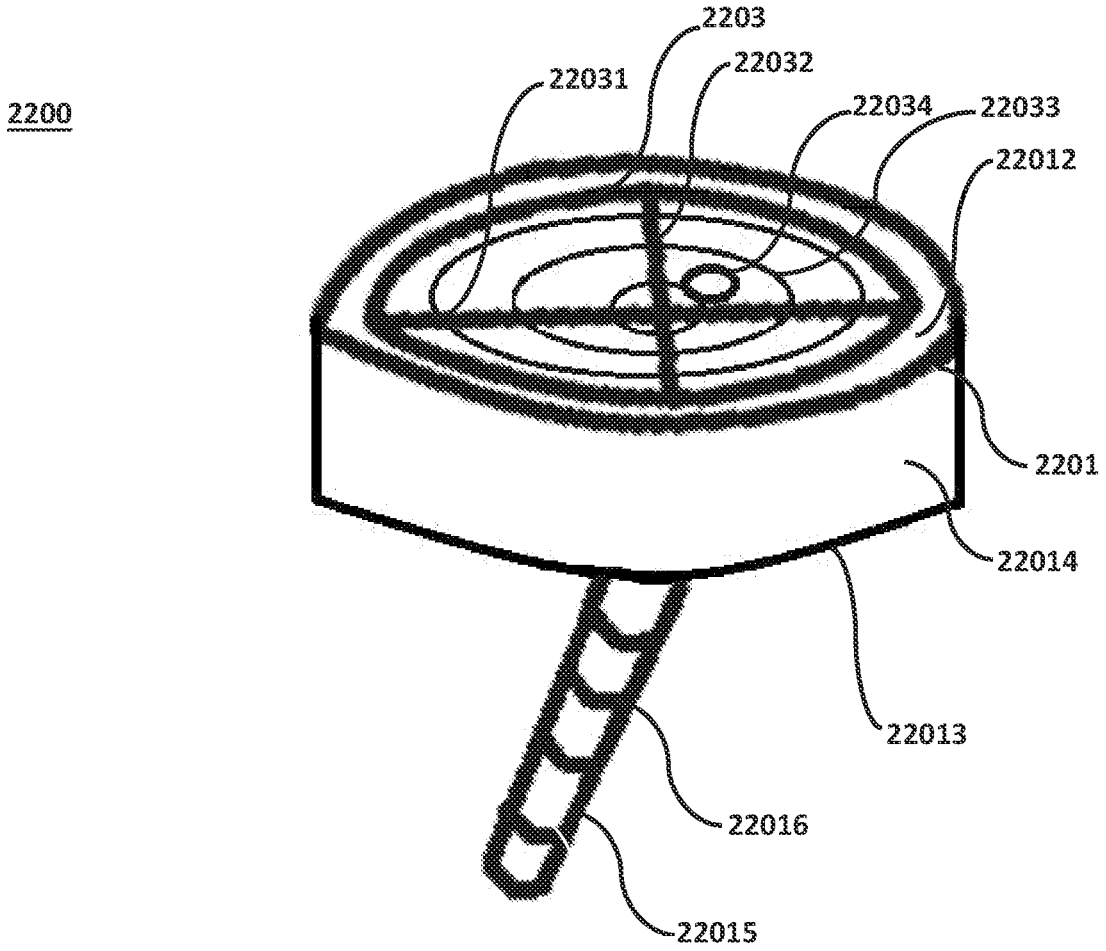
FIG. 24 shows a perspective view of a golf club fitting apparatus in accordance with an exemplary embodiment of the present invention.

Referring to FIGS. 22-24, a golf club fitting apparatus in accordance with an embodiment of the present invention is disclosed. FIG. 22 is a side view of a golf club fitting apparatus attached to a grip of a golf club, FIG. 23 is a side view of the grip and the golf club fitting apparatus, FIG. 24 is a perspective view of the golf club fitting apparatus.

As shown in FIG. 22, a putter 220 includes a putter head 2204. A shaft 2205 is attached to the putter head 2204. A shaft axis 2209 extends from the putter head 2204 through a center of the shaft 2205. When the putter 220 is held in a normal address position (e.g., held such that the putter's prescribed loft angle and lie angle are equal to the putter's effective loft angle and effective lie angle), the shaft axis 2209 is disposed at a lie angle β relative to a ground plane G. A grip 2206 is attached to the end of the shaft 2205 opposite the putter head 2204. The grip 2206 includes a butt end 22061 adjacent to a terminal portion of the shaft 2205 and a distal end 22071 opposite the butt end 22061. The butt end 22061 has a top surface 22063 which is substantially planar. The distal end 22071 of the grip 2206 has a bottom surface 22073 which is substantially planar. A golf club fitting apparatus 2200 is attached to the putter 220 at the butt end 22061 of the grip 2206.

Referring to FIG. 23, the grip 2206 and the golf club fitting apparatus 2200 attached thereto are shown in greater detail to elaborate some of the unique features of the grip 2206 and the golf club fitting apparatus 2200.

As shown in FIG. 23, the grip 2206 includes the butt end 22061 at a terminal end thereof. The top surface 22063 of the butt end 22061 is formed at an angle relative to a plane 2211 extending normal to the shaft axis 2209. The bottom surface 22073 of the distal end 22071 may be formed at an angle relative to a plane 2221 extending normal to the shaft axis 2209. The top surface 22063 of the butt end 22061 may be substantially parallel to the ground plane G when the putter 220 is held in a normal address position, and the bottom surface 22073 of the distal end 22071 may be substantially parallel to the ground plane G when the putter 220 is held in a normal address position. The bottom surface 22073 of the distal end 22071 may provide a visual indication as to the effective lie angle and the effective loft angle of the putter head 2204. The golf club fitting apparatus 2200 includes an apparatus body 2201. The apparatus body 2201 may be formed of metal, wood, plastic, or composites. According to an exemplary embodiment, the apparatus body 2201 of the golf club fitting apparatus 2200 may be formed of anodized 6061 aluminum.

The apparatus body 2201 includes a lower surface 22013, an upper surface 22012 opposite the lower surface 22013, and a lateral surface 22014 connecting the lower surface 22013 and the upper surface 22012. The lower surface 22013 of the apparatus body 2201 may be in contact with the top surface 22063 of the butt end 22061 of the grip 2206 when the golf club fitting apparatus 2200 is attached thereto. According to an embodiment of the present invention, the lower surface 22013 of the apparatus body 2201 and the top surface 22063 of the butt end 22061 may be configured to substantially conform to each other such that little or no gap exists between the grip 2206 and the golf club fitting apparatus 2200.

As shown in FIG. 23, the lower surface 22013 and the upper surface 22012 of the apparatus body 2201 may be formed substantially parallel to each other. Furthermore, the lower surface 22013 of the apparatus body 2201 may be substantially parallel to the top surface 22063 of the butt end 22061 of the grip 2206. Thus, the upper surface 22012 of the apparatus body 2201 may be substantially parallel to the ground plane G when the putter 220 is held in a normal address position.

Since the lower surface 22013 and the upper surface 22012 of the apparatus body 2201 and the top surface 22063 of the butt end 22061 of the grip 2206 are substantially parallel to each other, the critical dimension is a first angle $\theta_{21}$ between the top surface 22063 of the butt end 22061 and a plane 2211 extending normal to the shaft axis 2209. According to an embodiment of the present invention, the first angle $\theta_{21}$ may be between about 10° to about 30°, preferably the first angle $\theta_{21}$ may be about 15° to about 25°, and most preferably the first angle $\theta_{21}$ may be about 20° and complementary to the lie angle β.

When the first angle $\theta_{21}$ is in this range, the upper surface 22012 of the apparatus body 2201 is substantially parallel to the ground plane G when the putter 220 is held in the normal address position. The first angle $\theta_{21}$ ultimately controls the orientation of the golf club fitting apparatus 2200 relative to the ground plane G.

The bottom surface 22073 of the distal end 22071 of the grip 2206 may be oriented such that a second angle $\theta_{22}$ is formed between the bottom surface 22073 of the distal end 22071 of the grip 2206 and a plane 2221 extending normal to the shaft axis 2209. According to an embodiment of the present invention, the second angle $\theta_{22}$ may be between about 10° to about 30°, preferably the second angle $\theta_{22}$ may be about 15° to about 25°, and most preferably the second angle $\theta_{22}$ may be about 20° and complementary to the lie angle β. The top surface 22063 of the butt end 22061 and the bottom surface 22073 of the distal end 22071 may thus be parallel to each other.

It is noted that the shaft axis 2209 may not pass precisely through the center of the grip 2206. According to the rules of golf, a putter grip may be non-symmetrical. For example, as shown in FIG. 23 the grip 2206 may have a pistol shape where the circumference of the grip 2206 is greatest near the butt end 22061, and near the butt end 22061 a larger percentage of the grip 2206 is located on the underside of the grip 2206 from the perspective of a golfer.

Referring to FIG. 24, a perspective view of the golf club fitting apparatus 2200 allows for several additional features to be more clearly illustrated. As shown in FIG. 24, an angle indicator 2203 is coupled to the apparatus body 2201 and is exposed on the upper surface 22012 of the apparatus body 2201. The angle indicator 2203 may be secured to the apparatus body 2201 by press fitting, snap fitting, adhesion, mechanical fastening, or the like.

The angle indicator 2203 may further include a level indicator 22034. The angle indicator 2203 may be any angle indicator, including but not limited to a bubble level, a tilt sensor, a tilt indicator, a slope meter, a slope gauge, a gradient meter, a gradiometer, a level gauge, and a level meter.

Preferably the level indicator 22034 is a ball or a bubble configured to move about the angle indicator 2203 to indicate both effective loft angle and effective lie angle of the putter 220.

The angle indicator 2203 is configured to indicate both the effective loft angle and the effective lie angle of a putter. The angle indicator 2203 may further include markings 22033 defined thereon to provide a scale for measuring the effective lie angle and the effective loft angle of the putter 220 when held at address. The markings 22033 may be formed by any suitable manner, including but not limited to etching, molding, printing, or painting onto the angle indicator 2203.

According to an exemplary embodiment, as shown in FIG. 24 the markings 22033 may include a first axis 22031 and a second axis 22032. The first axis 22031 may be oriented such that an imaginary vertical plane including the first axis 22031 extends parallel a leading edge of the striking face of the putter 220 when the golf club fitting apparatus 2200 is attached thereto. The second axis 22032 may be perpendicular to the first axis 22031 such that an imaginary vertical plane including the second axis 22032 extends parallel to an aiming line when the golf club fitting apparatus 2200 is attached to the putter 220.

The intersection of the first axis 22031 and the second axis 22032 represent a neutral position of the putter 220 where the effective lie angle and the effective loft angle are equal to the prescribed lie angle and the prescribed loft angle, respectively. When the level indicator 22034 is located at the intersection of the first axis 22031 and the second axis 22032, it can be said that the putter 220 is positioned in the normal address position and exhibits both the prescribed lie angle and the prescribed loft angle.

Movement of the level indicator 22034 along the first axis 22031 corresponds to changes in the effective lie angle of the putter 220. Movement of the level indicator 22034 along the second axis 22032 corresponds to changes in the effective loft angle of the putter 220. Movement of the level indicator 22034 in other directions therefore corresponds to changes in both the effective loft angle and the effective lie angle of the putter 220.

By way of example, the level indicator 22034 as depicted in FIG. 24 is not centered about the intersection of the first axis 22031 and the second axis 22032. From the perspective of a golfer, the level indicator 22034 in FIG. 24 deviates from the second axis 22032 and is therefore positioned such that an effective lie angle of the putter is too great (i.e., the putter is being held too upright). The level indicator 22034 also deviates from the first axis 22031 and is therefore positioned such that the effective loft angle is too small (i.e., the putter is being overly forward-pressed such that the grip is being moved too close to the target).

By adjusting the address position of the putter 220 to center the level indicator 22034 about the intersection of the first axis 22031 and the second axis 22032 the putter 220 may be consistently positioned in the normal address position. By practicing positioning the putter 220 in this manner, a golfer may become more proficient in consistently and accurately addressing the golf ball. As detailed above, even a fraction of a degree of deviation from the normal address position can lead to missed putts. Therefore, the golf club fitting apparatus 2200 may go a long way to improving a golfer's setup and therefore their performance.

As shown in FIG. 24, in addition to or alternative to the first axis 22031 and the second axis 22032, the markings 22033 may include one or more concentric circles centered about the point of intersection of the first axis 22031 and the second axis 22032. As another example, the markings 22033 may include a grid centered about the intersection of the first axis 22031 and the second axis 22032 or a series of discrete marks disposed along the first axis 22031 and the second axis 22032. As yet another example, the markings 22033 may include a single point corresponding to the point of intersection of the first axis 22031 and the second axis 22032.

The markings 22033 of the angle indicator 2203 may be configured to indicate a range of deviations from the normal address position both in terms of lie angle and loft angle of between about −10 degrees to about 10 degrees, preferably between about −5 degrees to about 5 degrees, and most preferably between about −3 degrees to about 3 degrees.

Another feature of the present invention that is more clearly shown in FIG. 24 is a projection 22015 which extends from the lower surface 22013 of the apparatus body 2201. The projection 22015 is configured to secure the golf club fitting apparatus 2200 to the butt end 22061 of the grip 2206. The projection 22015 may have a tapered or constant diameter, and may include one or more ribs 22016 having an increased diameter relative to adjacent portions of the projection 22015. The projection 22015 is dimensioned so as to securely fit within a hole formed on the butt end 22061 of the grip 2206.

Though not shown in the drawings, according to an alternative embodiment of the present invention, a first magnet may be fixedly attached to the lower surface 22013 of the apparatus body 2201 and a second magnet may be attached to or formed integrally with the butt end 22061 of the grip 2206. The first and second magnets may have opposite polarities such that the golf club fitting apparatus 2200 may be removably coupled to the butt end 22061 of the grip 2206 via a magnetic force.

According to a further alternative embodiment, the golf club fitting apparatus 2200 may be removably coupled to the butt end 22061 of the grip 2206 using an adhesive or a mechanical fastener such as a screw.

Figure 25:
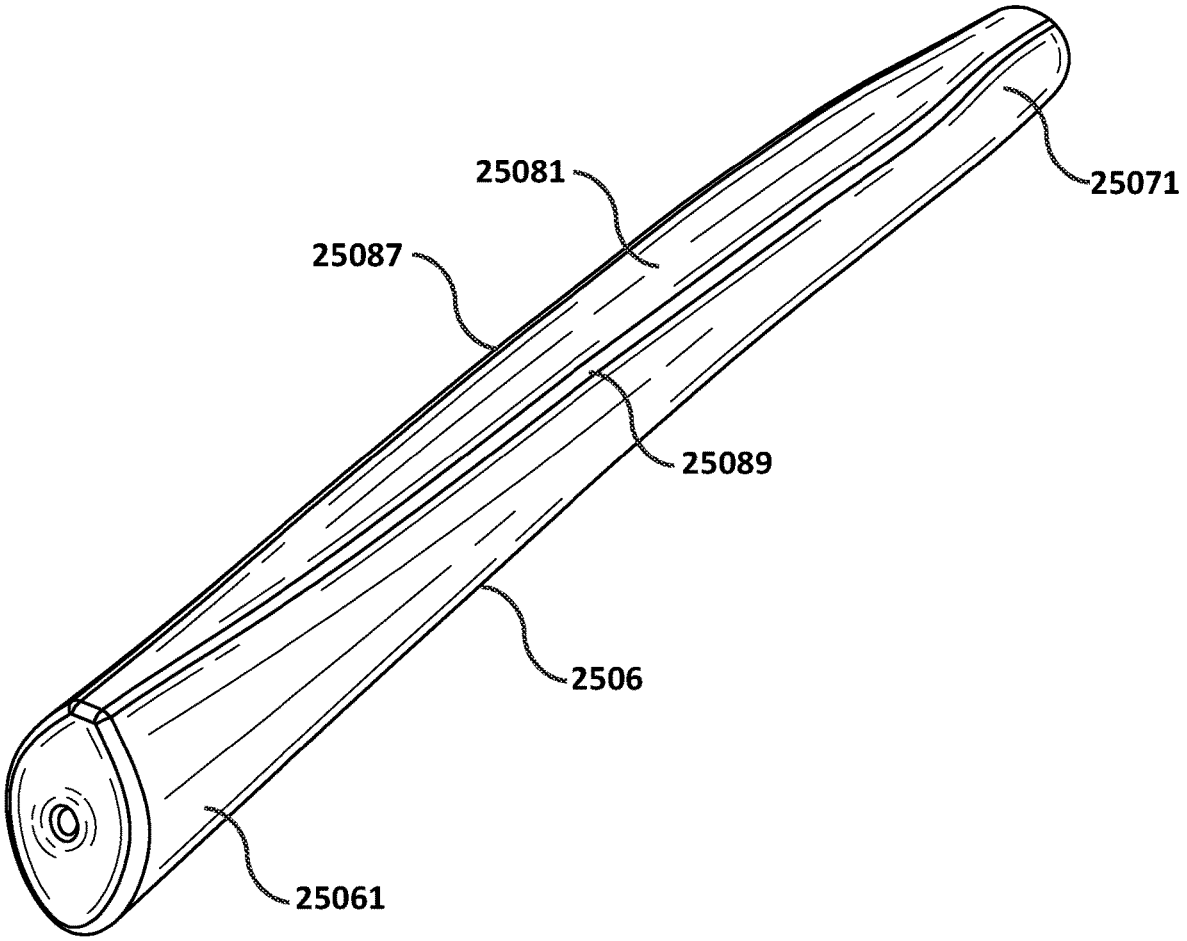
FIG. 25 shows a perspective view of a grip in accordance with an exemplary embodiment of the present invention.
Figure 26:
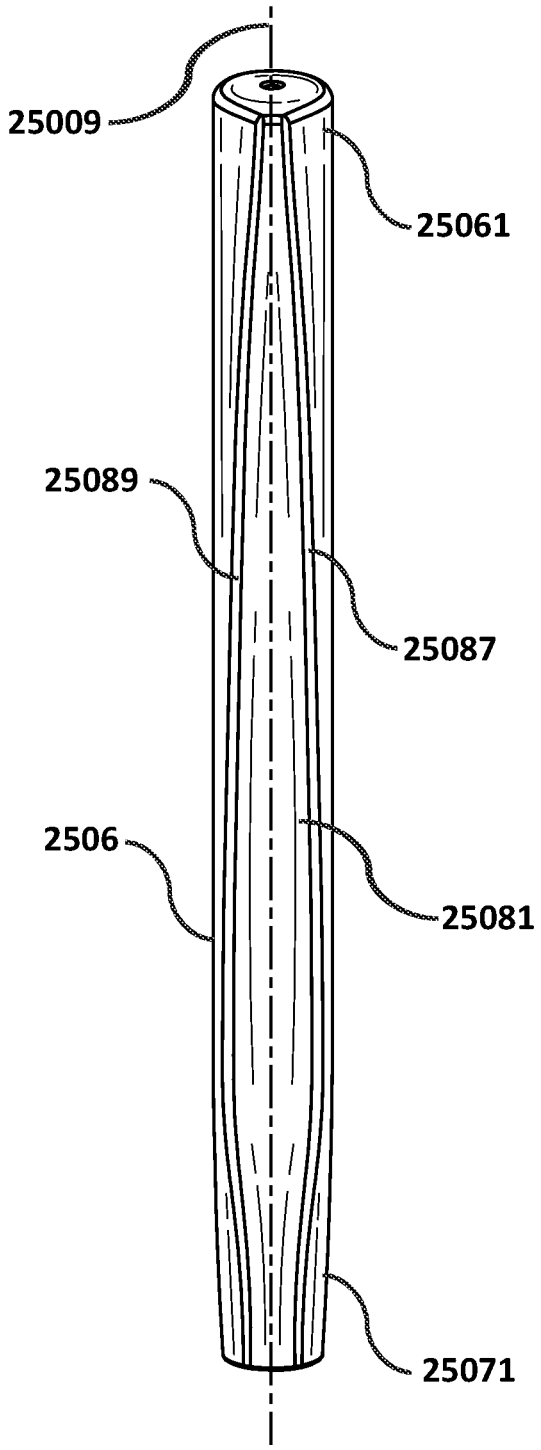
FIG. 26 shows a front view of a grip in accordance with an exemplary embodiment of the present invention.
Figure 27:
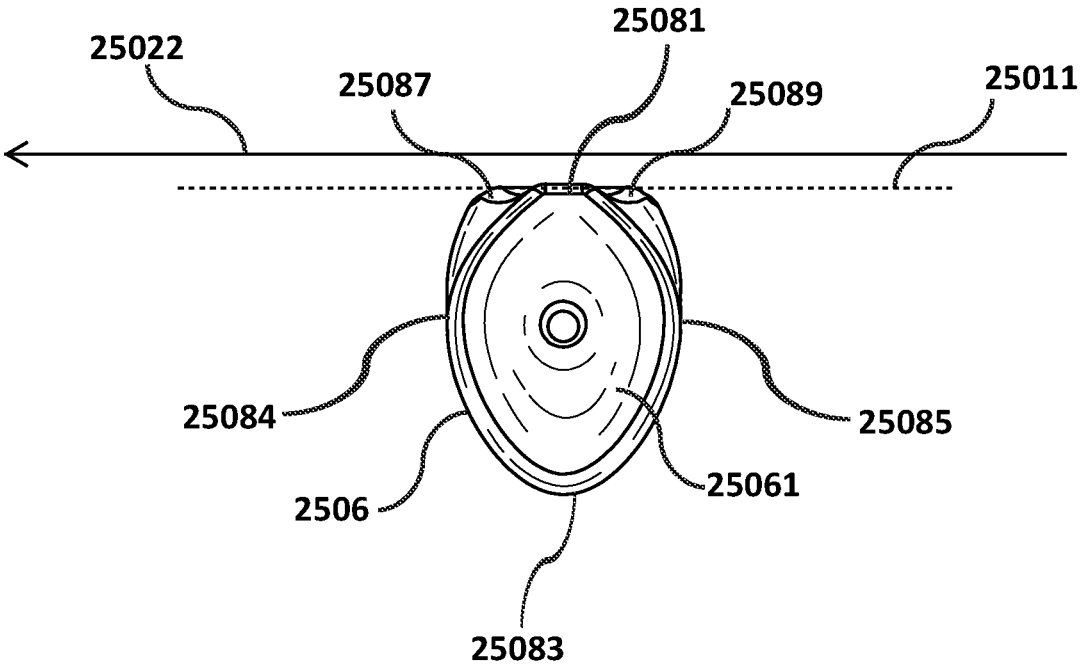
FIG. 27 shows a top view of a grip in accordance with an exemplary embodiment of the present invention.
Figure 28:
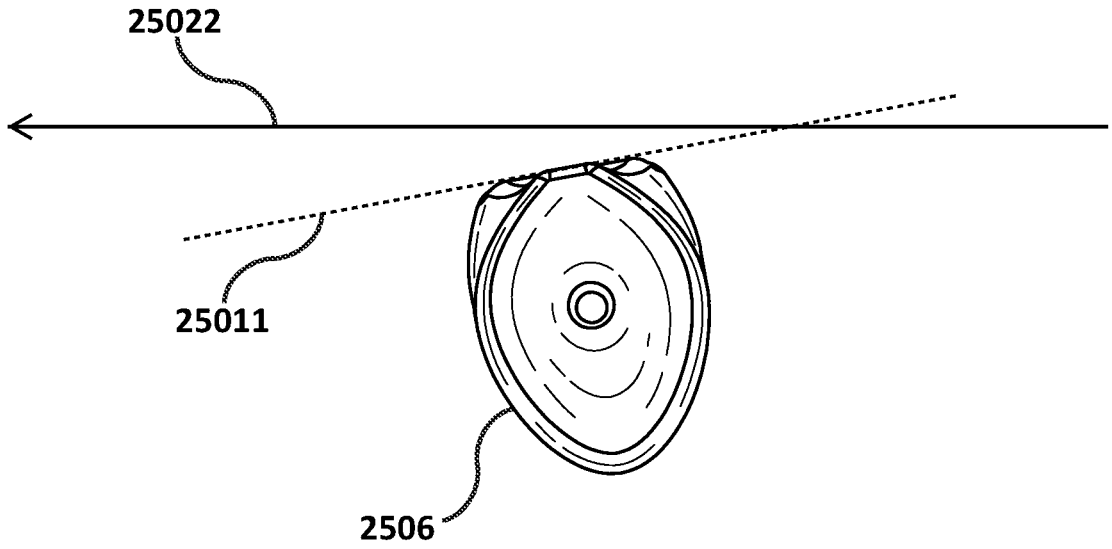
FIG. 28 shows a top view of a grip in accordance with an exemplary embodiment of the present invention.
Figure 29:
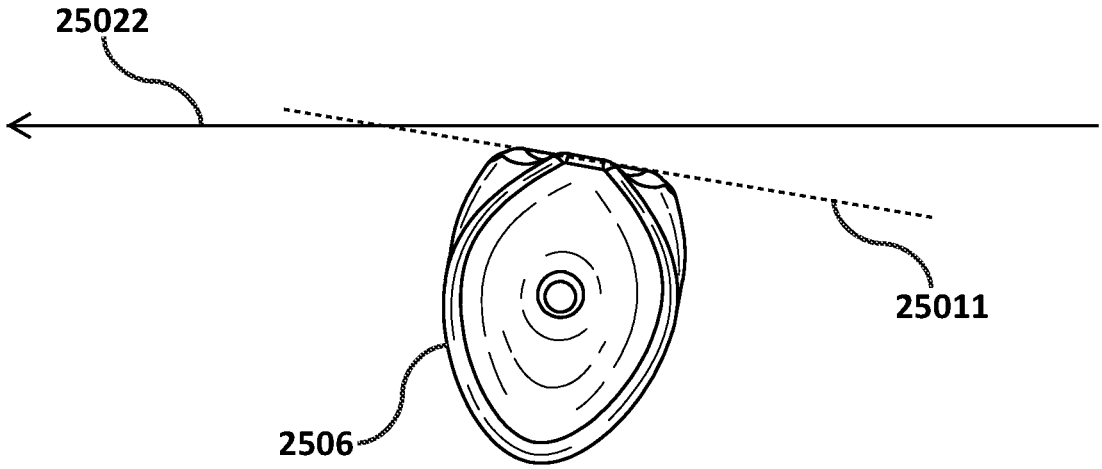
FIG. 29 shows a top view of a grip in accordance with an exemplary embodiment of the present invention.

Referring to FIGS. 25-29, a grip in accordance with an embodiment of the present invention is disclosed which aids in golf club fitting. FIG. 25 is perspective view of the grip, FIG. 26 is a front view of the grip, FIG. 27 is a top view of the grip, FIG. 28 is a top view of the grip in a first misaligned orientation, FIG. 29 is a top view of the grip in a second misaligned orientation.

As shown in FIG. 25, a grip 2506, configured to attach to a shaft having a shaft axis, includes a butt end 25061 adjacent to a terminal portion of the shaft when attached to the shaft, a distal end 25071 opposite the butt end 25061, and a front portion 25081 which is oriented in a direction facing away from a user in a normal address position.

As shown in FIGS. 26 and 27, the grip further includes a rear portion 25083, a left side portion 25084, and a right side portion 25085. The front portion 25081, the rear portion 25083, the left side portion 25084, and the right side portion 25085 extend along a length of the grip 2506 from the butt end 25061 to the distal end 25071. The front portion 25081 includes a left edge 25087 and a right edge 25089 extending the length of the grip 2506. The left edge 25087 and the right edge 25089 are symmetrical to each other along a centerline 25009 of the front portion 25081. Moving in a direction from the butt end 25061 to the distal end 25071 of the grip 2506, the left edge 25087 and the right edge 25089 taper away from the centerline 25009 of the front portion 25081 then taper back towards the centerline 25009 of the front portion 25081 near the distal end 25071 of the grip 2506. The left edge 25087 and the right edge 25089 of the front portion 25081 help improve feel and alignment for a user holding the grip 2506. The left edge 25087 and the right edge 25089 of the front portion 25081 may be smooth and continuous along the length of the grip 2506.

Referring to FIG. 27, a plane 25011 may be formed that includes at least a portion of the left edge 25087 and at least a portion of the right edge 25089, wherein the plane 25011 is parallel to a target line 25022 in a normal address position. The grip 2506 may be attached to a putter such that the plane 25011 is normal to a plane including a leading edge of a striking face of the putter. The orientation of the plane 25011 with respect to the target line 25022 provides a visual indication as to whether the striking face of the putter is normal, open, or closed with respect to the target line.

As shown in FIG. 28, the plane 25011 is angled with respect to the target line 25022. This orientation represents the striking face of the putter being in a closed position for a right-handed golfer and would cause a ball to be hit left of the target line 25022. For a left-handed golfer, the orientation shown in FIG. 28 would represent an open position and would cause a ball to be hit left of the target line 25022.

As shown in FIG. 29, the plane 25011 is angled with respect to the target line 25022 in an opposite direction as that shown in FIG. 28. The orientation shown in FIG. 29 represents the striking face of the putter being in an open position for the right-handed golfer and would cause the ball to be hit right of the target line 25022. For a left-handed golfer, the orientation shown in FIG. 29 would represent a closed position and would cause a ball to be hit right of the target line 25022.

According to other embodiments of the present invention, the grip described in FIGS. 25-29 may have the butt end with an upper surface being substantially planar and angled relative to a plane normal to a shaft axis as described in FIGS. 20 and 21. Additionally, the grip described in FIGS. 25-29 may include a golf club fitting apparatus attached to the butt end as described in FIGS. 16-18 or FIGS. 22-24.

According to embodiments of the present invention, the golf club fitting apparatus may be quickly and easily installed onto a golf club for use during practice, as the rules of golf do not allow for movable components to be attached to golf clubs during play. The configuration of the golf club fitting apparatus, specifically the upper surface of the apparatus body being substantially parallel to the ground plane in the normal address position, offsets the lie angle of the golf club such that the angle indicator may be centered relative to the ground when installed. The centered position of the angle indicator results in accurate and consistent installation and therefore accurate and consistent measurements of both effective loft angle and effective lie angle by the angle indicator. As a result, the golf club fitting apparatus according to embodiments of the present invention can uniquely improve a golfer's accuracy and consistency in setup, and therefore a golfer's accuracy and consistency in play.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

What is claimed is:

1. A golf club grip configured to attach to a shaft having a shaft axis, said golf club grip comprising:

a butt end configured to be located adjacent a terminal portion of said shaft;

a distal end opposite said butt end;

a front portion configured to face away from a golfer in a normal address position, a rear portion opposite said front portion, a first side portion between said front portion and said rear portion, and a second side portion opposite said first side portion extending a length of said grip from said butt end to said distal end; and a first edge and a second edge on said front portion extending said length of said grip, wherein said first edge and said second edge are symmetrical to each other along a centerline of said front portion, wherein, moving in a direction from said butt end to said distal end, said first edge and said second edge taper away from said centerline of said front portion then taper back towards said centerline of said front portion, wherein said butt end has a top surface which is substantially planar, wherein said top surface of said butt end is configured to form a first angle with respect to a first plane normal to said shaft axis when said golf club grip is attached to said shaft, said first angle being between about 10° and about 30°, wherein said top surface of said butt end is substantially parallel to a ground plane when said golf club grip is held in said normal address position, wherein said distal end has a bottom surface which is substantially planar, said bottom surface of said distal end is configured to form a second angle with respect to a second plane normal to said shaft axis when said golf club grip is attached to said shaft, said second angle being between about 10° and about 30°, and wherein said bottom surface of said distal end is substantially parallel to said ground plane when said grip is held in said normal address position.

2. The golf club grip of claim 1, wherein said first edge and said second edge are smooth and continuous along said length of said grip.

3. The golf club grip of claim 1, wherein, moving in said direction from said butt end to said distal end, said first edge and said second edge taper back towards said centerline of said front portion at a location nearer said distal end than said butt end.

4. The golf club grip of claim 1, wherein said first angle is about 20°.

5. The golf club grip of claim 1, wherein said first angle is complementary to a prescribed lie angle of said shaft axis.

6. The golf club grip of claim 1, wherein said second angle is about 20°.

* * * * *